US005810948A

United States Patent [19]

Nishiwaki et al.

[11] Patent Number: 5,810,948

[45] Date of Patent: Sep. 22, 1998

[54] NITRIDING STEEL EXCELLENT IN FORMABILITY AND SUSCEPTIBILITY TO NITRIDING AND PRESS FORMED ARTICLE THEREOF

[75] Inventors: Takeshi Nishiwaki; Kazumasa Yamazaki, both of Tokai; Kouichi Mine, Higashikamo-gun; Akio Hotta, Toyota; Kenji Shimoda, Nishikamo-gun, all of Japan

[73] Assignees: Nippon Steel Corporation, Tokyo; Toyota Jidosha Kabushiki Kaisha, Toyota, both of Japan

[21] Appl. No.: 809,012

[22] PCT Filed: Jul. 11, 1996

[86] PCT No.: PCT/JP96/01932

§ 371 Date: Mar. 7, 1997

§ 102(e) Date: Mar. 7, 1997

[87] PCT Pub. No.: WO97/03214

PCT Pub. Date: Jan. 30, 1997

[30] Foreign Application Priority Data

Jul. 12, 1995 [JP] Japan ..... 7-176082
Jul. 12, 1995 [JP] Japan ..... 7-176083

[51] Int. Cl.[6] ..... C22C 38/28; C22C 38/24; C23C 8/26

[52] U.S. Cl. ..... 148/318; 148/333; 420/103; 420/104

[58] Field of Search ..... 148/318, 333; 420/103, 104

[56] References Cited

U.S. PATENT DOCUMENTS

| | | | |
|---|---|---|---|
| Re. 31,251 | 5/1983 | Nakasugi et al. | 148/318 |
| 5,372,654 | 12/1994 | Satoh et al. | 148/318 |

FOREIGN PATENT DOCUMENTS

| | | | |
|---|---|---|---|
| 589415 | 3/1994 | European Pat. Off. | 148/318 |
| 53-113214 | 10/1978 | Japan . | |
| 55-76046 | 6/1980 | Japan . | |
| 2-80539 | 3/1990 | Japan . | |

*Primary Examiner*—Deborah Yee
*Attorney, Agent, or Firm*—Kenyon & Kenyon

[57] ABSTRACT

A nitriding steel excellent in formability and susceptibility to nitriding, comprising, based on weight, 0.0002 to less than 0.08% of C, 0.005 to 1.00% of Si, 0.010 to 3.00% of Mn, 0.001 to 0.150% of P, 0.0002 to 0.0100% of N, greater than 0.15 to 5.00% of Cr, greater than 0.060 to 2.00% of Al (Al becoming a selective component in an amount of greater than 0.10 to 2.00% when the C content is from 0.0002 to less than 0.0100%), one or two elements selected from 0.010 to 1.00% of Ti and 0.010 to 1.00% of V, and the balance Fe and unavoidable impurities, and a press formed article formed from the steel and having a hard nitride layer at least on one side.

10 Claims, 2 Drawing Sheets

NITRIDING STEEL EXCELLENT IN FORMABILITY AND SUSCEPTIBILITY TO NITRIDING AND PRESS FORMED ARTICLE THEREOF

FIELD OF THE INVENTION

The present invention relates to a nitriding steel excellent in formability and susceptibility to nitriding and a press formed article which is made of the steel, which is excellent in workability, particularly in deep drawability and wear resistance, and which is used for parts required to have wear resistance, fatigue strength and seizure resistance such as tools, parts for machine structures and parts for automobiles.

BACKGROUND OF THE INVENTION

Tools, parts for machine structures, parts for automobiles, and the like are required to have wear resistance, fatigue strength and seizure resistance. Accordingly, a process termed nitriding, for producing parts (formed articles of steel sheets being excluded) having a high surface hardness and a high internal hardness by making nitrogen invade the steel, has been employed. Since such steels (for example, Japanese Patent Kokai Publication Nos. 59-31850 and 59-50158) used for these parts are made to contain large amounts of nitriding-promoting elements, the steels have high strength but are difficult to work. As a result, a steel bar, or the like steel product is shaped by grinding, and then nitrided to have a high hardness. Shaping such a steel material, therefore, consumes time and becomes costly.

On the other hand, press forming is an easy, low cost forming method, and press formed articles can be produced by applying the method to a steel sheet such as a low carbon steel sheet and an extra low carbon steel sheet (e.g., Japanese Patent Kokai Publication No. 44-18066). Although steel parts having a necessary shape can be formed, the steel parts have been incapable of being made to have a high surface hardness which is important for their properties such as wear resistance, fatigue strength and seizure resistance. As described above, it has been impossible to produce a press formed article which is easily obtained by forming and which has a desired high surface hardness, by conventional methods. The compatibility of both properties has been a problem to be solved.

In such conventional techniques, grinding for shaping a steel material consumes much time and is costly. Even when a steel such as a free-cutting steel which can be easily ground is used, a shaping procedure in which a steel bar is ground to have a necessary shape consumes much time and is very costly. When forming methods often used for a steel sheet, particularly for a thin steel sheet, for example, press forming and bending can be applied to the steel, the cost related to forming steel parts can be greatly reduced, and the production efficiency can be significantly increased. Accordingly, a steel sheet which can be formed by a low cost forming method such as press forming and bending, and which is excellent in susceptibility to nitriding, namely an increase in hardness by nitriding is strongly desired.

The present invention is intended to solve the problems as mentioned above. An object of the present invention is to provide a nitriding steel to which forming such as press forming and bending can be applied and which is excellent in formability, particularly in deep drawability, as well as in susceptibility to nitriding.

A further object of the present invention is to provide a press formed article excellent in economy and productivity as well as in formability and wear resistance by the use of the steel.

A still further object of the present invention is to provide a press formed article having a surface hardness (Hv) of at least 400 and a limiting drawing ratio of at least 1.9.

DISCLOSURE OF THE INVENTION

The present invention has been achieved on the basis of the technical discovery that subjecting a steel sheet to press forming such as deep drawing forms an appropriate amount of dislocation therein, which promotes nitrogen diffusion and nitride formation, a nitride hardened layer thus being formed on the surface thereof to a desired depth in a short period of time.

In the present invention, the steel to be used is classified into a high C content steel containing from 0.01 to 0.08% by weight of C and a low C content steel containing from 0.0002 to 0.0100% by weight of C in accordance with the degree of difficulty in forming parts due to the shape thereof during the production of various parts or the degree of necessary strength. The chemical composition in accordance with any of the classified steels are then specified, and the steel sheet thus obtained is press formed and nitrided.

The high C content steel can be made to have a limiting drawing ratio (ratio of the diameter of a disc-shaped steel material (blank) to the limiting inner diameter of the cup bottom at which a rupture takes place during drawing (LDR)) of at least 1.9 and a hardness (Hv) of at least 400 at a site 30 $\mu$m below the surface at the same time by the method as described above. Moreover, the low C content steel can be made to have a limiting drawing ratio (LDR) of at least 2.0 and a hardness (Hv) of at least 400 at the same time by the method as described above.

That is, a high C content steel of the present invention is a nitriding steel excellent in formability and susceptibility to nitriding, which comprises, based on weight, 0.01 to less than 0.08% of C, 0.005 to 1.00% of Si, 0.010 to 3.00% of Mn, 0.001 to 0.150% of P, 0.0002 to 0.0100% of N, greater than 0.15 to 5.00% of Cr, greater than 0.060 to 2.00% of Al, one or two elements selected from 0.010% to less than 4C [%] of Ti and 0.010 to 1.00% of V, and the balance Fe and unavoidable impurities. The present invention also relates to a formed article obtained by press forming a steel sheet made of such a steel as mentioned above and having a hard nitride layer at least on one side. The steel sheet of the present invention is used for such parts required to have a high strength as parts for machine structures, and/or parts having a shape easily obtained by forming.

Furthermore, a low C content steel of the present invention is a nitriding steel excellent in formability and susceptibility to nitriding, which comprises, based on weight, 0.0002 to less than 0.0100% of C, 0.005 to 1.00% of Si, 0.010 to 3.00% of Mn, 0.001 to 0.150% of P, 0.0002 to 0.0100% of N, greater than 0.80 to 5.00% of Cr, one or at least two elements selected from the nitriding hardening element group consisting of greater than 0.10 to 1.00% of V, greater than 0.10 to 2.00% of Al and 0.010 to 1.00% of Ti, 0.005 to 0.060% of Nb and 0.0005 to 0.0050% of B if necessary, and the balance Fe and unavoidable impurities. The present invention also relates to a formed article obtained by press forming a steel sheet made of such a steel as mentioned above and having a hard nitride layer at least on one side. The steel sheet of the present invention is used for parts which are not specifically required to have a high strength and/or which have a shape difficult to form.

DETAILED DESCRIPTION OF THE PREFERRED EMBODIMENT

Figure 1:
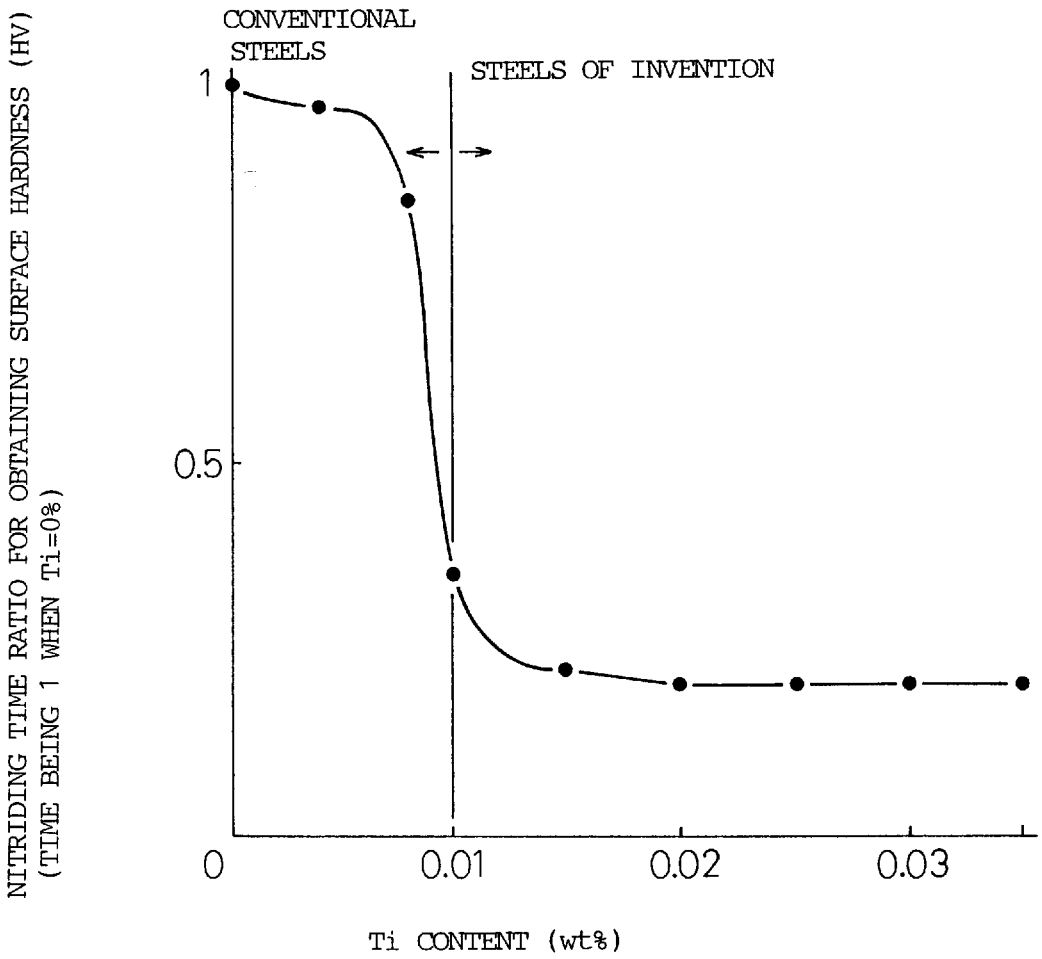
FIG. 1 is a graph showing the relationship between a Ti concentration and a nitriding time ratio (time ratio being 1 when Ti=0%) for obtaining a surface hardness (Hv) of 400.

First, the present invention will be explained in detail by making reference to a high C content steel.

To ensure the formability of steel plates or sheets, the steel contains elements in respective ranges as described below.

C is an element which influences the formability of a steel, and the formability is lowered as the content increases. Moreover, when the content is large, the deterioration of formability is promoted when other elements are added. The C content is, therefore, defined to be less than 0.08%. Furthermore, since the strength of the steel for machine structures becomes insufficient when the C content is less than 0.01%, the lower limit of the C content is defined to be 0.01%.

Although Si is added to improve the formability of a steel, the production of the steel becomes significantly costly and as a result uneconomical when the Si content is less than 0.005%. The lower limit of the Si content is, therefore, defined to be 0.005%. Since the steel does not have high formability when the Si content exceeds 1.00%, the upper limit of the Si content is defined to be 1.00%.

Mn is similar to Si in that it is added to a steel to improve the formability thereof. However, the production of the steel becomes significantly costly and as a result uneconomical when the Mn content is less than 0.010%. The lower limit of the Mn content is, therefore, defined to be 0.010%. Since a steel does not have high formability when the Mn content exceeds 3.00%, the upper limit thereof is defined to be 3.00%.

Although P is an element which enhances the strength of a steel without impairing the formability and which is added in an amount in accordance with a strength level of the steel, the production of the steel becomes significantly costly and as a result uneconomical when the P content is less than 0.001%. The lower limit of the P content is, therefore, defined to be 0.001%. Since a problem of secondary working embrittlement arises when the P content exceeds 0.150%, the upper limit of thereof is defined to be 0.150%.

To ensure the formability of a steel, a lower N content is better. Since the production of the steel becomes significantly costly and as a result uneconomical when the N content is less than 0.0002%, the lower limit thereof is defined to be 0.0002%. Since the formability of the steel is deteriorated when the N content exceeds 0.0100%, the upper limit thereof is defined to be 0.0100%.

A steel having a limiting drawing ratio (LDR) of at least 1.9 and a deep drawability of at least 1.9 can be provided by the addition of the components as mentioned above.

A nitriding-promoting element group for increasing the susceptibility to nitriding of a steel includes Cr, Al, Ti and V. Since the susceptibility to nitriding is not increased when the addition amounts are not satisfactory, the lower limits thereof are defined. Since the steel cannot be practically used due to the deterioration of formability when the addition amounts increase, the upper limits of the components are defined.

Cr is a very important element for nitriding hardening. Since an amount of the hardness increase of a steel caused by nitriding is small when the Cr content is up to 0.15%, the Cr content is defined to be greater than 0.15%. Since the formability of the steel is deteriorated when the Cr content exceeds 5.00%, the upper limit thereof is defined to be 5.00%.

Al is usually added as a deoxidation component, and it prevents the formation of defects such as blow holes. Al is, therefore, required to be added in an amount of at least 0.005%. Al has a strong affinity for N and is an element which greatly hardens the surface layer of the nitride layer. To enhance the susceptibility to nitriding as in the present invention, the addition of Al in an amount of up to 0.060% is unsatisfactory because an amount of the hardness increase caused by nitriding is small. The steel of the present invention, therefore, contains Al in an amount exceeding 0.060%, preferably at least 0.080%. Moreover, since the formability of the steel is deteriorated when the Al content exceeds 2.00%, the upper limit thereof is defined to be 2.00%.

The hardness of a steel is significantly increased by nitriding when the steel is prepared by adding Ti and V together with predetermined amounts of Cr and Al.

Ti is an element which forms nitride more strongly than Cr and Al, and is also one which powerfully promotes nitriding even when a nitriding time is short. Accordingly, the steel may have a surface hardened layer even when treated in a short period of time. Since a hardness increase of the steel caused by nitriding is small when the Ti content is less than 0.010%, the lower limit thereof is defined to be 0.0010%. Moreover, Ti is an element which strongly forms a carbide, and all the carbon atoms in the steel form coarse precipitates when the Ti content is four times the C content (4C [%]) to weaken the intergranular bonding strength. As a result, the steel slab tends to form cracks very easily during casting and hot rolling. Accordingly, the upper limit of the Ti content defined to be less than four times the C content. That is, since Ti forms TiC as a carbide, the Ti content is defined to be as follows: C>(12/48)Ti.

The effect of adding Ti on nitriding in a short period of time will be made clear by the experiments as described below.

A steel having a chemical composition as shown in Table 1 was prepared by melting, and continuously cast conventionally to give a slab. The slab was heated to 1,200° C. in a heating furnace, and hot rolled with a finishing temperature of 910° C. The hot rolled steel was coiled at 600° C., pickled, cold rolled with a reduction of 80%, and recrystallization annealed at 800° C. for 60 sec to give a cold rolled steel sheet.

Using the cold rolled steel sheet, press formed articles were prepared at a limiting drawing ratio of 1.9. The press formed articles were used as test pieces, and test was conducted to obtain a readiness of forming a surface hardened layer (quickness of nitriding) as indicated by a nitriding time. After preparing the test pieces, they were nitrided in an atmosphere of a gas mixture of $NH_3$ and endothermic gas at 570° C. while the nitriding time was varied, and oil cooled. The hardness (Hv) of the surface hardened layer on each of the test pieces was measured with a micro Vickers hardness meter. A nitriding time necessary for obtaining a hardness (Hv) of 400 of the surface hardened layer was determined from the results, and the quickness of nitriding was evaluated from the ratio of the nitriding time to that with Ti=0%.

The results thus obtained are shown in Table 1 and FIG. 1. It is evident from Table 1 and FIG. 1 that a steel to which Ti has been added in an amount of at least 0.01% and less than four times the C content can be nitrided in a short period of time compared with the steel having a Ti content of 0% to obtain a surface hardened layer having the same hardness as that of the steel (Ti content: 0%). It is understood from the results that the steel is, therefore, excellent in the quickness of nitriding.

TABLE 1

| S. | Chemical composition (wt. %) | | | | | | | | | |
|---|---|---|---|---|---|---|---|---|---|---|
| No. | C | Si | Mn | P | N | Cr | Al | V | Ti | *1 |
| 1 | 0.024 | 0.050 | 0.150 | 0.010 | 0.0032 | 0.240 | 0.090 | 0.120 | — | 1.00 |
| 2 | 0.025 | 0.052 | 0.130 | 0.012 | 0.0038 | 0.245 | 0.093 | 0.128 | 0.0051 | 0.975 |
| 3 | 0.029 | 0.050 | 0.142 | 0.015 | 0.0032 | 0.241 | 0.090 | 0.115 | 0.0079 | 0.850 |
| 4 | 0.026 | 0.053 | 0.141 | 0.015 | 0.0033 | 0.243 | 0.093 | 0.123 | 0.0101 | 0.350 |
| 5 | 0.025 | 0.051 | 0.150 | 0.008 | 0.0034 | 0.241 | 0.099 | 0.120 | 0.014B | 0.220 |
| 6 | 0.026 | 0.055 | 0.132 | 0.016 | 0.0026 | 0.249 | 0.096 | 0.122 | 0.0203 | 0.200 |
| 7 | 0.024 | 0.052 | 0.136 | 0.012 | 0.0031 | 0.242 | 0.092 | 0.126 | 0.0248 | 0.195 |
| 8 | 0.024 | 0.050 | 0.140 | 0.012 | 0.0033 | 0.240 | 0.095 | 0.119 | 0.0303 | 0.193 |
| 9 | 0.027 | 0.058 | 0.150 | 0.008 | 0.0026 | 0.245 | 0.092 | 0.122 | 0.0349 | 0.192 |

Note:
S. No. = Sample No.
*1: a nitriding time necessary for obtaining a surface hardness (Hv) of 400 (the time being 1 when Ti = 0%)

V promotes the diffusion of N in a steel, and makes N invade the interior thereof to form a thick nitride layer on the steel surface. Since a hardness increase caused by nitriding is small when the V content is less than 0.010%, the lower limit of the V content is defined to be 0.010%. Since the formability of the steel is deteriorated when the V content exceeds 1.00%, the upper limit thereof is defined to be 1.00%. Moreover, V is a carbide-forming element, and makes carbon atoms in the steel precipitate to weaken the intergranular bond strength. As a result, the steel slab tends to form cracks though the degree of forming cracks is not great compared with the one in which Ti is used. Accordingly, the V content is up to 5.67 times the C content (C [%]), that is, since V forms $V_4C_3$ as carbides, it is preferred that $C>(12/51)\times(3/4)\times V$.

The effect of V addition on the N invasion as described above was studied by the following experiment where the depth from the surface at which the surface hardened layer had a hardness (Hv) of 400 was determined.

A steel having a chemical composition listed in Table 2 was prepared by melting, and a cold rolled steel sheet was prepared by the same process as in Table 1.

The same press formed articles as in Table 1 were formed therefrom, and test was conducted by nitriding to determine the hardened depth of the surface hardened layer. A test piece was prepared, and the test piece was nitrided at 570° C. for 4 hours in an atmosphere of a gas mixture of $NH_3$ gas and endothermic gas, followed by oil cooling the test piece. The hardness (Hv) of the surface hardened layer was measured by using a micro Vickers hardness meter, and the depth from the surface at which a Hv of 400 was obtained was determined. The depth in terms of $\mu$m was used as a measure of the surface-hardened depth.

Figure 2:
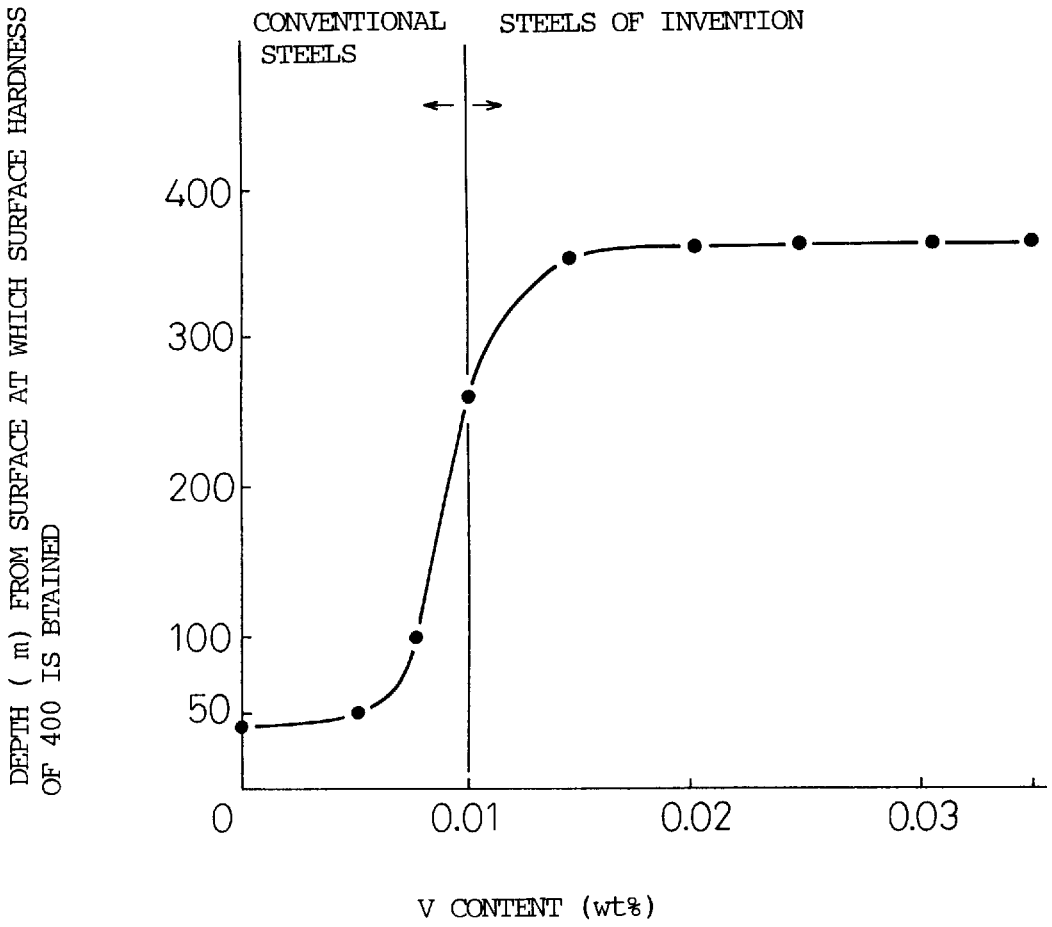
FIG. 2 is a graph showing the relationship between a V concentration and a depth for obtaining a surface hardness (Hv) of 400.

The results thus obtained are shown in Table 2 and FIG. 2.

It is clear from Table 2 and FIG. 2 that those steels to which at least 0.01% of V has been added each have a deep surface hardened layer and are, therefore, excellent in nitriding-caused hardened depth.

TABLE 2

| S. | Chemical composition (wt. %) | | | | | | | | | |
|---|---|---|---|---|---|---|---|---|---|---|
| No. | C | Si | Mn | P | N | Cr | Al | V | Ti | *2 |
| 1 | 0.025 | 0.051 | 0.156 | 0.011 | 0.0035 | 0.241 | 0.091 | — | 0.026 | 40.0 |
| 2 | 0.026 | 0.055 | 0.135 | 0.013 | 0.0031 | 0.245 | 0.092 | 0.0052 | 0.025 | 50.1 |
| 3 | 0.028 | 0.052 | 0.136 | 0.013 | 0.0032 | 0.242 | 0.091 | 0.0078 | 0.024 | 100.2 |
| 4 | 0.026 | 0.050 | 0.142 | 0.011 | 0.0032 | 0.241 | 0.091 | 0.0102 | 0.026 | 260.2 |
| 5 | 0.024 | 0.052 | 0.149 | 0.016 | 0.0034 | 0.249 | 0.097 | 0.0147 | 0.028 | 352.3 |
| 6 | 0.027 | 0.053 | 0.152 | 0.012 | 0.0024 | 0.242 | 0.094 | 0.0202 | 0.022 | 360.1 |
| 7 | 0.023 | 0.051 | 0.136 | 0.015 | 0.0032 | 0.240 | 0.093 | 0.0247 | 0.024 | 362.2 |
| 8 | 0.026 | 0.056 | 0.142 | 0.014 | 0.0034 | 0.245 | 0.095 | 0.0305 | 0.026 | 363.1 |
| 9 | 0.028 | 0.057 | 0.155 | 0.010 | 0.0028 | 0.241 | 0.094 | 0.0348 | 0.028 | 363.3 |

Note:
S. No. = Sample No.
*2: a surface hardened depth ($\mu$m)

Ti and V are selective components in the present invention. However, even when the addition amount of V is up to the range of the present invention and the depth from the surface of the nitrided surface layer at which the hardness (Hv) is 400 is less than 250 $\mu$m, the steel can be nitrided in a short period of time by the addition of Ti in a range defined by the present invention, and, therefore, a short nitriding furnace can be used. Moreover, even when the addition amount of Ti is up to the range of the present invention and the rate of nitriding is made small, for example, when a long nitriding furnace is used, a steel sheet having a depth of the nitrided surface layer from the surface as mentioned above as sufficiently deep as at least 250 μm can be obtained by the addition of V in a range defined by the present invention. That is, a desired nitriding rate and a desired nitrided depth can be freely selected.

When a sufficiently deep nitrided layer is to be formed in a short period of time, Ti and V are naturally added in the range of the present invention. The most preferred upper values in relation to C are represented by the formula:

$$C>(12/48)\times Ti+(12/51)\times(3/4)\times V$$

The present invention will be illustrated in detail by making reference to a low C steel.

To ensure the formability, particularly the deep drawability of the steel sheet of the present invention, the steel contains the following components in the following ranges.

C is an element which influences the deep drawability of a steel, and the deep drawability of the steel is deteriorated when the content is increased. When the content is high, the deterioration of the deep drawability is promoted by the addition of other elements. Accordingly, the C content is less than 0.0100%. Moreover, when the C content is less than 0.0002%, the cost of highly purifying the steel increases and, as a result the production becomes very costly and uneconomical. The lower limit of the C content is, therefore, defined to be 0.0002%.

Since the production of a steel becomes very costly and uneconomical when the Si content is less than 0.005%, the lower limit of the Si content is defined to be 0.005%. Since a good deep drawability of the steel cannot be obtained when the Si content exceeds 1.00%, the upper limit thereof is defined to be 1.00%.

Since the production of a steel becomes very costly and uneconomical when the Mn content is less than 0.010%, the lower limit of the Mn content is defined to be 0.010%. Since a good deep drawability of the steel cannot be obtained when the Mn content exceeds 3.00%, the upper limit thereof is defined to be 3.00%.

Although P is an element which enhances the strength of a steel without impairing the deep drawability and which is added in an amount in accordance with a strength level of the steel, the production of the steel becomes very costly and uneconomical when the P content is less than 0.001%. The lower limit of the P content is, therefore, defined to be 0.001%. Since a problem of secondary working embrittlement arises when the P content exceeds 0.150%, the upper limit thereof is defined to be 0.150%.

To ensure the formability of a steel, a lower N content is better. However, since the production of the steel becomes very costly and uneconomical when the N content is less than 0.0002%, the lower limit thereof is defined to be 0.0002%. Since the deep drawability of the steel is deteriorated when the N content exceeds 0.0100%, the upper limit thereof is defined to be 0.0100%.

Furthermore, the steel of the present invention may contain Nb in an amount of at least 0.005% to 0.060% as an element for improving the deep drawability. Nb forms fine carbide, nitride and carbonitride in the steel, and prevents the deterioration of the deep drawability of the steel caused by the presence of dissolved C and N. Nb is, therefore, added to the steel.

The effect of Nb on precipitating and fixing C and N is insignificant when the Nb content is less than 0.005%, the lower limit of the Nb content is defined to be 0.005%. Since the deep drawability of the steel is deteriorated when the Nb content exceeds 0.060%, the upper limit thereof is defined to be 0.060%.

The steel of the present invention may contain B in an amount of at least 0.0005% and up to 0.0050% of B as an element for preventing secondary working embrittlement. B is added to strengthen grain boundaries of the steel which are weakened, due to a low C content, and prevent the secondary working embrittlement. Since the effect of B on preventing the secondary working embrittlement is insignificant when the B content is less than 0.0005%, the lower limit of the B content is defined to be 0.0005%. Since the deep drawability of the steel is deteriorated when the B content exceeds 0.0050%, the upper limit thereof is defined to be 0.0050%. In addition, since B has a strong affinity for nitride, B does not hinder the susceptibility to nitriding of the steel and may further improve it which steel contains nitride-forming elements in ranges defined in the present invention.

The addition range of B has been obtained by the experiment as described below.

Using part of a cold rolled steel sheet obtained in Example 2 which will be described later, a secondary working embrittlement test was conducted. In conducting the test, a cup was first formed with a drawing ratio of 1.9 (primary working), and then a conical punch was pushed to expand the periphery of the cup (secondary working). When a steel material having a significant embrittlement tendency suffers a secondary working, a crack is longitudinally formed. The secondary working embrittlement of steels was evaluated from the occurrence rate of the cracks. The results thus obtained were summarized in Table 3.

It is evident from Table 3 that the occurrence rate of a longitudinal crack formed by the secondary working embrittlement falls for steels in which B has been added, and that the steels have, therefore, high resistance to crack formation caused by the secondary working embrittlement.

In addition, the sample Nos. in Table 3 correspond to the sample Nos. in Table 8 (1) to Table 8 (6).

TABLE 3

| S. | Chemical composition (wt. %) | | | | | | | | | | | |
|---|---|---|---|---|---|---|---|---|---|---|---|---|
| No. | C# | Si | Mn | P | N | Cr | Al | V | Ti | Nb | B | *O |
| 17 | 52 | 0.322 | 0.265 | 0.024 | 0.0035 | 0.954 | 0.134 | 0.11 | 0.12 | — | — | x |
| 18 | 65 | 0.352 | 0.523 | 0.032 | 0.0067 | 0.871 | 1.756 | 0.90 | 0.72 | — | — | x |
| 23 | 34 | 0.021 | 1.323 | 0.074 | 0.0045 | 3.862 | 0.150 | 0.16 | 0.15 | — | — | x |
| 24 | 10 | 0.010 | 0.302 | 0.005 | 0.0034 | 2.862 | 1.643 | 0.78 | 0.85 | — | — | x |
| 41 | 51 | 0.320 | 0.260 | 0.022 | 0.0037 | 0.850 | 0.143 | 0.14 | 0.01 | 0.041 | — | x |
| 42 | 67 | 0.360 | 0.545 | 0.031 | 0.0062 | 0.879 | 1.730 | 0.93 | 0.71 | 0.048 | — | ○ |
| 47 | 27 | 0.022 | 1.395 | 0.075 | 0.0045 | 3.826 | 0.155 | 0.17 | 0.19 | 0.024 | — | x |
| 48 | 16 | 0.011 | 0.356 | 0.010 | 0.0036 | 2.796 | 1.650 | 0.79 | 0.92 | 0.012 | — | x |
| 53 | 30 | 0.022 | 2.252 | 0.012 | 0.0058 | 0.838 | — | 0.12 | 0.04 | — | — | ○ |
| 56 | 80 | 0.362 | 0.751 | 0.058 | 0.0037 | 4.415 | — | 0.98 | 0.76 | — | — | x |

TABLE 3-continued

| S. | Chemical composition (wt. %) | | | | | | | | | | | |
|---|---|---|---|---|---|---|---|---|---|---|---|---|
| No. | C# | Si | Mn | P | N | Cr | Al | V | Ti | Nb | B | *O |
| 61 | 72 | 0.028 | 2.225 | 0.014 | 0.0056 | 0.840 | — | 0.12 | 0.03 | 0.033 | — | x |
| 64 | 22 | 0.316 | 0.784 | 0.058 | 0.0038 | 4.324 | — | 0.96 | 0.93 | 0.016 | — | ○ |
| 65 | 49 | 0.320 | 0.265 | 0.034 | 0.0036 | 0.855 | 0.125 | 0.10 | 0.10 | — | 0.0006 | ⊕ |
| 66 | 40 | 0.342 | 0.523 | 0.022 | 0.0068 | 0.905 | 1.708 | 0.95 | 0.78 | — | 0.0048 | ⊕ |
| 67 | 33 | 0.022 | 1.323 | 0.075 | 0.0044 | 3.850 | 0.146 | 0.12 | 0.14 | — | 0.0035 | ⊕ |
| 68 | 18 | 0.011 | 0.302 | 0.006 | 0.0032 | 2.769 | 1.608 | 0.81 | 0.88 | — | 0.0026 | ⊕ |
| 69 | 50 | 0.322 | 0.263 | 0.023 | 0.0036 | 0.854 | 0.134 | 0.11 | 0.01 | 0.042 | 0.0031 | ⊕ |
| 70 | 45 | 0.352 | 0.535 | 0.033 | 0.0068 | 0.871 | 1.756 | 0.90 | 0.72 | 0.030 | 0.0029 | ⊕ |
| 71 | 32 | 0.021 | 1.305 | 0.076 | 0.0044 | 3.862 | 0.150 | 0.16 | 0.12 | 0.023 | 0.0010 | ⊕ |
| 72 | 15 | 0.010 | 0.314 | 0.006 | 0.0031 | 2.862 | 1.643 | 0.78 | 0.84 | 0.012 | 0.0019 | ⊕ |
| 73 | 69 | 0.021 | 2.541 | 0.013 | 0.0048 | 0.909 | — | 0.13 | 0.03 | — | 0.0030 | ⊕ |
| 74 | 42 | 0.363 | 0.568 | 0.059 | 0.0045 | 4.300 | — | 0.97 | 0.86 | — | 0.0008 | ⊕ |
| 75 | 75 | 0.029 | 2.550 | 0.015 | 0.0033 | 0.822 | — | 0.16 | 0.05 | 0.032 | 0.0048 | ⊕ |
| 76 | 61 | 0.302 | 0.018 | 0.061 | 0.0036 | 4.385 | — | 0.98 | 0.94 | 0.048 | 0.0015 | ⊕ |

Note:
S. No. = Sample No.
C#: C content in terms of ppm
*O: Occurrence rate of a longitudinal crack
⊕: 0%, ○: 0 to 10%, x: at least 10%

Examples of nitriding-promoting elements for enhancing the susceptibility to nitriding of the steel are the same as in the low C content steel, and they are Cr, V and Ti.

Cr is an element which is very important in hardening a steel by nitriding. Since a hardness increase thereof caused by nitriding is small when the Cr content is up to 0.80%, the steel is necessarily defined to contain Cr in an amount exceeding 0.80%. Since the deep drawability of the steel is deteriorated when the Cr content exceeds 5.00%, the upper limit of the Cr content is defined to be 5.00%. The hardness increase caused by nitriding is made significant by adding Al, V and Ti together with a predetermined amount of Cr.

Since Al is usually added as a deoxidizing component to prevent the formation of defects such as blow holes, Al is required to be added in an amount of at least 0.005%. When Al is used as a deoxidizing component, the lower limit of the Al content is 0.005%. However, since Al is an element which has a strong affinity for nitrogen and which greatly hardens the surface layer of a nitride layer, a hardness increase of the steel caused by nitriding is insignificant when the Al content is up to 0.10%. The lower limit of the Al content for enhancing the susceptibility to nitriding is, therefore, defined to be greater than 0.10%. Since the deep drawability of the steel comes to be deteriorated when the Al content exceeds 2.00%, the upper limit thereof is defined to be 2.00%.

Since V promotes N diffusion to make N invade the interior of a steel, a thick nitride layer can be formed on the steel surface. Since a hardness increase of the steel caused by nitriding is insignificant when the V content is up to 0.10%, the lower limit thereof is defined to be greater than 0.10%. Since the deep drawability of the steel comes to be deteriorated when the V content exceeds 1.00%, the upper limit thereof is defined to be 1.00%.

Since Ti tends to form nuclei of nitrides, Ti is an element which powerfully promotes nitriding even in a short nitriding time. A surface hardened layer can, therefore, be obtained in a short period of time. Since a hardness increase caused by nitriding is small when the Ti content is less than 0.010%, the lower limit of the Ti content is defined to be 0.010%. Since the deep drawability of a steel comes to be deteriorated when the Ti content exceeds 1.00%, the upper limit thereof is defined to be 1.00%. When Ti is added to improve the deep drawability of the steel, the Ti content is preferably at least 0.005%.

That Ti is a powerful nitriding element which can shorten nitriding time is shown by the experiment described below.

A steel having a chemical composition as shown in Table 4 was prepared by melting, and a cold rolled steel sheet was obtained by the same process as in Table 1. Press formed articles were prepared with a limiting drawing ratio of 1.90 from the cold rolled steel sheet. The press formed articles were used as test pieces, and a test was conducted to decide the readiness of the formation of a surface hardened layer (quickness of nitriding) while the nitriding time was used as the measure thereof. After preparing the test pieces, they were nitrided at 570° C. in an atmosphere of a gas mixture of $NH_3$ and endothermic gas while the nitriding time was varied, and oil cooled. The hardness (Hv) of the surface hardened layer was measured using a micro Vickers hardness meter. A nitriding time necessary for obtaining a hardness (Hv) of 400 of the surface hardened layer was determined from the results, and the quickness of nitriding was evaluated from the ratio of the time to the time for the steel with Ti=0%.

The results are summarized in Table 4. It is clear from Table 4 that a steel to which 0.01% of Ti has been added can be nitrided in a short period of time to form a surface hardened layer having the same hardness, and that the steel is, therefore, excellent in the quickness of nitriding.

Accordingly, when Ti is added to steel in an amount of at least 0.010%, a surface hardened layer having a desired hardness can be formed in a time of less than 0.35 (time being 1 when Ti=0%). The nitriding time may, therefore, be shortened, and extremely significant industrial effects can be obtained.

TABLE 4

| S. | Chemical composition (wt. %) | | | | | | | | | | | |
|---|---|---|---|---|---|---|---|---|---|---|---|---|
| No. | C# | Si | Mn | P | N | Cr | Al | V | Nb | B | Ti | *1 |
| 1 | 35 | 0.011 | 0.015 | 0.008 | 0.0054 | 0.851 | 0.134 | 0.11 | — | — | — | 1 |
| 2 | 10 | 0.008 | 0.132 | 0.006 | 0.0026 | 0.869 | 0.766 | 0.96 | — | — | 0.0021 | 0.99 |
| 3 | 96 | 0.215 | 1.502 | 0.011 | 0.0034 | 3.811 | 0.125 | 0.19 | — | — | 0.0045 | 0.98 |
| 4 | 62 | 0.826 | 0.626 | 0.014 | 0.0069 | 2.851 | 1.641 | 0.76 | — | 0.0010 | 0.0062 | 0.90 |
| 5 | 27 | 0.514 | 0.050 | 0.009 | 0.0009 | 0.849 | 0.130 | 0.12 | 0.031 | — | 0.0080 | 0.840 |
| 6 | 8 | 0.055 | 2.930 | 0.007 | 0.0022 | 0.968 | 1.775 | 0.95 | 0.056 | — | 0.0098 | 0.600 |
| 7 | 32 | 0.122 | 0.265 | 0.024 | 0.0035 | 0.854 | 0.134 | 0.11 | — | — | 0.0123 | 0.300 |
| 8 | 25 | 0.492 | 0.523 | 0.032 | 0.0067 | 1.071 | 1.756 | 0.90 | — | — | 0.0250 | 0.195 |
| 9 | 64 | 0.021 | 1.323 | 0.074 | 0.0045 | 1.862 | 0.150 | 0.16 | — | 0.0023 | 0.0462 | 0.190 |
| 10 | 53 | 0.030 | 0.302 | 0.005 | 0.0034 | 2.862 | 1.643 | 0.78 | — | — | 0.0501 | 0.189 |
| 11 | 93 | 0.006 | 0.060 | 0.022 | 0.0037 | 0.860 | 0.143 | 0.14 | 0.041 | — | 0.0702 | 0.186 |
| 12 | 27 | 0.216 | 0.545 | 0.131 | 0.0062 | 0.879 | 1.730 | 0.93 | 0.051 | — | 0.0911 | 0.185 |
| 13 | 67 | 0.722 | 1.395 | 0.075 | 0.0095 | 3.826 | 0.155 | 0.17 | 0.024 | — | 0.0988 | 0.185 |

Note:
S. No. = Sample No.
C#: C content in terms of ppm
*1: ratio of time necessary for obtaining a hardness (Hv) of 400 in the surface hardened layer (time being 1 when Ti = 0%)

The chemical composition of the steel is adjusted as described above. When the deep drawability is strongly required, the C content is made at least 0.0002% and less than 0.0100%, and it is desirable, for the purpose of precipitating and fixing C and N, to add Ti in an amount of at least $\{(48/12)\times C[\%]+(48/14)\times N[\%]\}$, or Nb in an amount of 0.8 times $\{(93/12)\times C[\%]+(93/14)\times N[\%]\}$, or Nb in an amount of at least $0.8\times(93/12)\times C[\%]\times\{1-(Ti[\%]-(48/14)\times N[\%]\}$ in the case of compositely adding Ti and Nb and adding Ti in an amount less than $\{(48/12)\times C[\%]+(48/14)\times N[\%]\}$.

The production process of the present invention will be explained.

Any heating and rolling condition may be selected after casting as a process for producing the steel sheet having a composition as mentioned above. When the steel is hot rolled, there are no specific limitations on procedures prior to hot rolling and procedures for hot rolling. However, the steel sheet is preferably coiled at temperature of at least 500° C. to improve the formability. When a thickness accuracy and a formability of the steel sheet are required, the steel sheet is desirably cold rolled further with a reduction of at least 50%. Although a high formability of the steel sheet is brought about when the steel sheet is cold rolled with a reduction of at least 50%, most desirably the steel sheet is cold rolled with a reduction of at least 70%. The steel sheet is subsequently recrystallization annealed. The steel sheet may be annealed either by box annealing or by continuous annealing. Although there are no specific requirements for the annealing conditions, the steel sheet is preferably annealed at temperature of at least the recrystallization temperature and up to 900° C. where coarse grains are not formed. The steel sheet of the present invention may safely be subjected to operations such as temper rolling, oil coating and solid lubricant oil coating so that the formability of the steel sheet is improved and the appearance thereof becomes excellent after forming.

The hot rolled steel sheet or cold rolled steel sheet thus prepared is subjected to press forming such as deep drawing, whereby a suitable amount of dislocation is formed therein. The dislocation formed by forming such as deep drawing promotes N diffusion and nitride formation, and the nitride hardened layer can be obtained in a short period of time. A formed article excellent in wear resistance can, therefore, be obtained. Moreover, the steel sheet thus obtained hardly suffers surface crack formation due to the hardened layer, and the steel sheet exhibits improved fatigue strength and seizure resistance.

Objects related to the formability of the present invention are bending, ironing, blanking, and the like operation which can form an appropriate amount of dislocation in addition to deep drawing, depending on the shape of the formed article.

When the formed article is formed to have a predetermined shape and nitrided, a hard nitride layer can be formed on the steel sheet surface of the formed article. Moreover, the hard nitride layer of the present invention designates a nitride compound layer of the surface layer, or the nitride compound layer and a hard N diffusion layer formed in the interior of the steel sheet.

There are various nitriding treatments such as gas nitriding, gas soft nitriding, salt bath nitriding, ion nitriding, acid nitriding and sulfurizing nitriding. Any of such treatments may be applied so long as a hard nitride layer is formed is formed on the surface layer. The treatment time may be suitably varied so that a necessary nitride layer depth can be obtained.

Furthermore, the thickness of the surface nitride layer (compound layer) thus obtained may safely be reduced by any of procedures such as grinding so that the layer thickness or the surface roughness is adjusted.

The hardness of the hard nitride layer is satisfactory when the layer has a micro Vickers hardness of at least about 400. Although the upper limit of the hardness is not restricted, it is about 1,500 in the current nitriding techniques.

Furthermore, though a hard layer (diffusion layer) in which the nitride is enriched is effective when the layer has a thickness of at least 10 $\mu$m, the layer desirably has a thickness of at least 200 $\mu$m to stably exhibit a further effect.

A preferred concrete example of the production process as described above is shown below.

A steel having a chemical composition according to the present invention is prepared by melting, and cast into a slab by a conventional continuous casting method. The slab is heated to temperature of 1,000° to 1,300° C. in a heating furnace, hot rolled with finishing temperature from 700° to 1,000° C., and coiled at temperature of room temperature to 850° C. to give a hot rolled steel sheet.

The steel sheet is pickled, if necessary, cold rolled with a reduction of at least 30%, and recrystallization annealed by holding it at temperature of 600° to 900° C. for 1 to 300 sec to give a cold rolled steel sheet.

The hot rolled or cold rolled steel sheet is deep drawn, for example, with a limiting drawing ratio of at least 1.9. The formed article is degreased, nitrided in an atmosphere of a gas mixture of $NH_3$ and endothermic gas at temperature of 450° to 650° C. for 0.1 to 100 hours, and cooled to give a part having a surface hardness (Hv) of at least 400.

An experiment in which formed articles prepared by the deep drawing method of the present invention and ones prepared by grinding were compared with respect to the surface hardness is described below.

A steel having a chemical composition as listed in Table 5 was prepared by melting, and conventionally continuous cast into a slab. The slab was heated to 1,200° C. in a heating furnace, hot rolled with finishing temperature of at least 910° C., and coiled at 700° C. The hot rolled steel sheet was pickled, cold rolled with a reduction of 80%, and recrystallization annealed at 800° C. for 60 sec to give a cold rolled steel sheet having a thickness of 1.2 mm. A disc (blank) having a diameter of 60 mm was cut out of the cold rolled steel sheet, and press formed with a drawing ratio of 2.0 to give a deep drawn formed article in a cup form.

On the other hand, a steel block was cut out of the same slab, and ground to give a cup-form part having the same form. A comparative formed article was thus prepared.

These formed articles were nitrided in an atmosphere of a gas mixture of $NH_3$ and endothermic gas at 570° C. for 30 minutes, and oil cooled. The susceptibility to nitriding of each of the formed articles was evaluated from the hardness (Hv) at a site 30 $\mu$m below the surface of the article which hardness was measured with a micro Vickers hardness meter.

The results thus obtained are summarized in Table 5. It is clear from Table 5 that the press formed articles of the present invention each have a hard surface nitride layer compared with the comparative press formed articles, and that the press formed articles of the invention are thus excellent in susceptibility to nitriding.

TABLE 5

| Sample | Chemical composition (wt. %) | | | | | | |
|---|---|---|---|---|---|---|---|
| No. | C | Si | Mn | P | N | Cr | Al |
| 1 | 0.0226 | 0.017 | 0.575 | 0.025 | 0.0043 | 0.611 | 0.083 |
| 2 | 0.0622 | 0.018 | 0.578 | 0.026 | 0.0036 | 0.632 | 0.105 |
| 3 | 0.0026 | 0.017 | 0.575 | 0.025 | 0.0043 | 0.811 | 0.083 |
| 4 | 0.0078 | 0.018 | 0.578 | 0.026 | 0.0036 | 1.882 | 0.105 |

TABLE 5-continued

| Sample | Chemical composition (wt. %) | | | | Forming by deep drawing | Forming by gringing |
|---|---|---|---|---|---|---|
| No. | V | Ti | Nb | B | (Hv) | (Hv) |
| 1 | 0.12 | 0.02 | — | — | 512 | 230 |
| 2 | 0.32 | 0.02 | — | — | 503 | 211 |
| 3 | 0.33 | 0.02 | 0.015 | — | 561 | 270 |
| 4 | 0.32 | 0.02 | — | 0.0010 | 602 | 323 |

Furthermore, an experiment was carried out to investigate the influence of the presence of a nitride layer on a deep drawn press formed article surface of the present invention on the wear resistance.

A steel having a chemical composition as listed in Table 5 was prepared by melting, and conventionally continuous cast into a slab. The slab was heated to 1,250° C. in a heating furnace, hot rolled with finishing temperature of at least 910° C., and coiled at 530° C. The hot rolled steel sheet was pickled, cold rolled with a reduction of 75%, and recrystallization annealed at 780° C. for 40 sec to give a cold rolled steel sheet having a thickness of 1.8 mm. A disc (blank) having a diameter of 80 mm was cut out of the cold rolled steel sheet, and press formed with a drawing ratio of 2.0 to give a deep drawn formed article in a cup form. The press formed parts thus obtained were nitrided in an atmosphere of a gas mixture of $NH_3$ and endothermic gas at 570° C. for 4 hours, and oil cooled. Test pieces each having a size of 10 mm×10 mm were cut out of the bottom portion of each of the test pieces, whereby test pieces each having a hard nitride layer on both sides were prepared. Moreover, the openings of part of the cup form parts were closed during nitriding, and the inner surface of each of the parts was not exposed to the atmosphere of the gas mixture of $NH_3$ gas and endothermic gas. As a result, a hard nitride layer was formed only on the outer surfaces of the cup form parts. Test pieces each having a hard nitride layer on one side alone were thus prepared. A rotary grinding plate was pressed to the test pieces under a constant load, and the test pieces were made to suffer rotary wear until the thickness of the test piece is decreased by 0.1 mm. The wear resistance of each of the test pieces was evaluated from the total number of rotation of the grinding plate.

The results thus obtained are summarized in Table 6. It is seen from comparison between comparative examples and examples in Table 6 that the press formed articles of the present invention each having a hard nitride layer are excellent in wear resistance.

TABLE 6

| S. | Chemical composition (wt. %) | | | | | | | | | Example T.R.N.# | | C. Ex. T.R.N.# |
|---|---|---|---|---|---|---|---|---|---|---|---|---|
| No. | C | Si | Mn | P | N | Cr | Al | V | Ti | 1* | 2* | 3* |
| 1 | 0.0250 | 0.015 | 0.325 | 0.020 | 0.0041 | 0.253 | 0.082 | 0.05 | 0.02 | ⊕ | ○ | x |
| 2 | 0.0653 | 0.016 | 0.320 | 0.016 | 0.0026 | 0.706 | 0.106 | 0.15 | 0.02 | ⊕ | ⊕ | x |

TABLE 6-continued

| S. | Chemical composition (wt. %) | | | | | | | | | Example T.R.N.# | | C. Ex. T.R.N.# |
|---|---|---|---|---|---|---|---|---|---|---|---|---|
| No. | C | Si | Mn | P | N | Cr | Al | V | Ti | 1* | 2* | 3* |
| 3 | 0.0025 | 0.025 | 0.323 | 0.016 | 0.0040 | 0.853 | 0.082 | 0.14 | 0.02 | ⊕ | ○ | x |
| 4 | 0.0073 | 0.016 | 0.330 | 0.019 | 0.0027 | 1.706 | 0.106 | 0.15 | 0.02 | ⊕ | ⊕ | x |

Note:
S. No. = Sample No.
#T.R.N. = Total Rotation Number
1*: a formed article having a nitride layer on both sides
2*: a formed article having a nitride layer on one side
3*: a formed article having no nitride layer
⊕: at least $10^7$ times, ○: $10^3$ to less than $10^7$ times, x less than $10^3$ times As explained above, the deep drawn press formed articles according to the present invention each have a high surface hardness and an excellent wear resistance.

EXAMPLES

Example 1

The present invention will be concretely explained by making reference to examples.

A steel having a chemical composition as shown in Table 7 (1) was prepared by melting, and conventionally continuous cast into a slab. The slab was heated to 1,200° C. in a heating furnace, hot rolled with finishing temperature of at least 910° C., and coiled at a temperature as listed in Table 7 (2), followed by pickling to give a hot rolled steel sheet.

The hot rolled steel sheet was cold rolled further with a reduction as shown in Table 7 (2), and recrystallization annealed at 800° C. for 60 sec to give a cold rolled steel sheet. Discs (blanks) each having a diameter of 60 mm were cut out of the hot rolled steel sheet and the cold rolled steel sheet, and press formed with a drawing ratio of 1.9 or 2.0 to give cup parts. The cup parts were further formed using punches and dies having various diameters in combination so that the limiting drawing ratio (LDR) of each of the samples was determined.

Test pieces were separately prepared, degreased, nitrided by heating them in an atmosphere of a gas mixture of $NH_3$ and endothermic gas at 570° C. for 4 hours, and oil cooled. The susceptibility to nitriding of each of the test pieces was evaluated from the hardness (Hv) determined with a micro Vickers hardness meter at a site 30 μm deep from the surface.

The results thus obtained are shown in Tables 7 (1) and 7 (2). It is clear from comparison between comparative steels and steels of invention in the tables that the deep drawn articles obtained from the steels of the present invention are excellent in formability and form a hard surface nitride layer due to their excellent susceptibility to nitriding. Moreover, it is seen from comparison between the comparative steels and the steels of the invention having the same nitrided layer hardness that the steels of the present invention each exhibit a large limiting drawing ratio and that they are, therefore, excellent in formability.

Example 2

A steel having a chemical composition as shown in Tables 8 (1) to 8 (3) was prepared by melting, and conventionally continuous cast into a slab. The slab was heated to 1,200° C. in a heating furnace, hot rolled with finishing temperature of at least 910° C., and coiled at a coiling temperature as listed in Tables 8 (4) to 8 (6), followed by pickling to give a hot rolled steel sheet. The hot rolled steel sheet was cold rolled further with a reduction as shown in Tables 8 (4) to 8 (6), and recrystallization annealed at 800° C. for 60 sec to give a cold rolled steel sheet. Discs (blanks) each having a diameter of 60 mm were cut out of the hot rolled steel sheet and the cold rolled steel sheet, and press formed with a drawing ratio of 2.0 or 2.1 to give cup parts. Cup parts were further formed using punches and dies having various diameters in combination so that the limiting drawing ratio (LDR) of each of the samples was determined.

Test pieces were separately prepared, degreased, nitrided by heating them in an atmosphere of a gas mixture of $NH_3$ and endothermic gas at 570° C. for 4 hours, and oil cooled. The susceptibility to nitriding of the test pieces was evaluated from the hardness (Hv) determined with a micro Vickers hardness meter at a site 30 μm deep from the surface.

The results thus obtained are shown in Tables 8 (4) to 8 (6). It is clear from comparison between comparative steels and steels of invention in the tables that the press formed articles each having a hard nitride layer and obtained from the steels of the present invention are excellent in press formability and wear resistance. Moreover, it is seen from comparison between the comparative steels and the steels of the invention having the same nitrided layer hardness that the steels of the present invention each exhibit a large limiting drawing ratio and that they are, therefore, excellent in deep drawability.

TABLE 7 (1)

| S. | Chemical composition (wt. %) | | | | | | | | |
|---|---|---|---|---|---|---|---|---|---|
| No. | C | Si | Mn | P | N | Cr | Al | V | Ti |
| 1 | 0.036 | 0.030 | 0.142 | 0.015 | 0.0052 | 0.161 | 0.061 | 0.02 | — |
| 2* | 0.020 | 0.303 | 0.298 | 0.007 | 0.0041 | 0.185 | 0.065 | 0.11 | — |
| 3* | 0.020 | 0.302 | 0.301 | 0.005 | 0.0033 | 0.183 | 0.063 | 0.95 | — |
| 4* | 0.019 | 0.010 | 0.150 | 0.030 | 0.0002 | 0.160 | 0.065 | — | 0.02 |

TABLE 7 (1)-continued

| S. | Chemical composition (wt. %) | | | | | | | | |
|---|---|---|---|---|---|---|---|---|---|
| No. | C | Si | Mn | P | N | Cr | Al | V | Ti |
| 5* | 0.032 | 0.012 | 0.130 | 0.012 | 0.0018 | 0.175 | 0.063 | — | 0.12 |
| 6* | 0.079 | 0.022 | 2.254 | 0.013 | 0.0056 | 0.159 | 0.065 | 0.04 | 0.05 |
| 7* | 0.070 | 0.035 | 0.311 | 0.006 | 0.0038 | 0.195 | 0.062 | 0.39 | 0.27 |
| 8* | 0.075 | 0.036 | 0.302 | 0.004 | 0.0039 | 0.185 | 0.061 | 0.99 | 0.29 |
| 9* | 0.040 | 0.018 | 0.450 | 0.038 | 0.0026 | 4.615 | 0.062 | 0.06 | — |
| 10* | 0.067 | 0.025 | 0.772 | 0.010 | 0.0031 | 4.351 | 0.062 | 0.37 | — |
| 11* | 0.057 | 0.022 | 0.780 | 0.012 | 0.0034 | 4.415 | 0.063 | 0.89 | — |
| 12* | 0.042 | 0.023 | 0.237 | 0.013 | 0.0042 | 3.043 | 0.062 | — | 0.03 |
| 13* | 0.054 | 0.051 | 1.121 | 0.012 | 0.0054 | 3.543 | 0.065 | — | 0.21 |
| 14* | 0.034 | 0.017 | 1.275 | 0.085 | 0.0043 | 4.611 | 0.063 | 0.03 | 0.05 |
| 15* | 0.055 | 0.300 | 0.750 | 0.046 | 0.0033 | 4.400 | 0.062 | 0.31 | 0.15 |
| 16* | 0.050 | 0.304 | 0.778 | 0.056 | 0.0036 | 4.411 | 0.065 | 0.92 | 0.16 |
| 17* | 0.042 | 0.211 | 0.650 | 0.008 | 0.0054 | 0.171 | 0.094 | 0.02 | — |
| 18* | 0.058 | 0.602 | 1.020 | 0.015 | 0.0024 | 0.179 | 1.752 | 0.32 | — |
| 19* | 0.068 | 0.605 | 1.232 | 0.006 | 0.0026 | 0.189 | 1.756 | 0.95 | — |
| 20* | 0.012 | 0.201 | 2.772 | 0.009 | 0.0044 | 0.161 | 0.095 | – | 0.02 |
| 21* | 0.021 | 0.015 | 0.653 | 0.012 | 0.0025 | 0.176 | 1.830 | — | 0.08 |
| 22* | 0.060 | 0.322 | 0.255 | 0.024 | 0.0035 | 0.174 | 0.104 | 0.02 | 0.02 |
| 23* | 0.065 | 0.354 | 0.568 | 0.038 | 0.0029 | 0.189 | 1.753 | 0.36 | 0.25 |
| 24* | 0.073 | 0.352 | 0.523 | 0.032 | 0.0067 | 0.191 | 1.756 | 0.90 | 0.29 |
| 25* | 0.024 | 0.035 | 0.822 | 0.011 | 0.0034 | 3.811 | 0.105 | 0.09 | — |
| 26* | 0.039 | 0.042 | 0.267 | 0.013 | 0.0066 | 2.856 | 1.640 | 0.02 | — |
| 27* | 0.029 | 0.046 | 0.266 | 0.014 | 0.0069 | 2.851 | 1.641 | 0.79 | — |
| 28* | 0.041 | 0.022 | 0.236 | 0.012 | 0.0041 | 3.042 | 0.082 | — | 0.04 |
| 29* | 0.053 | 0.050 | 1.120 | 0.012 | 0.0053 | 3.540 | 1.925 | — | 0.20 |
| 30* | 0.042 | 0.021 | 1.323 | 0.144 | 0.0096 | 3.862 | 0.083 | 0.06 | 0.05 |
| 31* | 0.068 | 0.785 | 0.122 | 0.010 | 0.0032 | 2.525 | 1.631 | 0.38 | 0.25 |
| 32* | 0.019 | 0.980 | 0.012 | 0.005 | 0.0034 | 2.862 | 1.643 | 0.78 | 0.07 |
| 33# | 0.155 | 0.165 | 2.433 | 0.022 | 0.0034 | 0.140+ | 0.065 | — | — |
| 34# | 0.075 | 0.073 | 1.665 | 0.021 | 0.0048 | 6.069+ | 0.065 | — | — |
| 35# | 0.064 | 0.648 | 0.323 | 0.065 | 0.0032 | 0.458 | 3.250+ | — | — |
| 36# | 0.132+ | 0.354 | 0.321 | 0.011 | 0.0021 | 0.362 | 0.074 | 1.59+ | — |
| 37# | 0.045 | 0.351 | 1.513 | 0.009 | 0.0033 | 0.125+ | 0.045+ | — | 0.008+ |

Note:
*: steel of invention
#: steel of comparative example
+: the component being out of the range of the present invention

TABLE 7 (2)

| | Coil- | Reduction | Hot rolled steel sheet | | | | Cold rolled steel sheet | | | |
|---|---|---|---|---|---|---|---|---|---|---|
| | ing | in cold | Drawing 1.9 | | Drawing 2.0 | | Drawing 1.9 | | Drawing 2.0 | |
| Sample No. | temp. (°C.) | rolling (%) | Form-ing | Hv | Form-ing | Hv | Form-ing | Hv | Form-ing | Hv |
| 1* | 598 | 65.5 | ○ | 417 | ○ | 422 | ○ | 420 | ○ | 425 |
| 2* | 536 | 56.3 | ○ | 567 | ○ | 572 | ○ | 578 | ○ | 583 |
| 3* | 525 | 54.8 | ○ | 578 | ○ | 681 | ○ | 677 | ○ | 682 |
| 4* | 551 | 58.0 | ○ | 405 | ○ | 410 | ○ | 405 | ○ | 411 |
| 5* | 623 | 78.5 | ○ | 660 | ○ | 565 | ○ | 676 | ○ | 683 |
| 6* | 750 | 70.3 | ○ | 457 | ○ | 451 | ○ | 470 | ○ | 475 |
| 7* | 635 | 58.1 | ○ | 685 | ○ | 701 | ○ | 703 | ○ | 708 |
| 8* | 632 | 55.3 | ○ | 754 | ○ | 759 | ○ | 757 | ○ | 762 |
| 9* | 526 | 58.9 | ○ | 745 | ○ | 753 | ○ | 750 | ○ | 754 |
| 10* | 792 | 55.1 | ○ | 814 | ○ | 820 | ○ | 816 | ○ | 821 |
| 11* | 810 | 56.8 | ○ | 836 | ○ | 842 | ○ | 838 | ○ | 843 |
| 12* | 711 | 76.6 | ○ | 748 | ○ | 753 | ○ | 759 | ○ | 764 |
| 13* | 739 | 55.5 | ○ | 812 | ○ | 817 | ○ | 813 | ○ | 819 |
| 14* | 641 | 53.2 | ○ | 746 | ○ | 751 | ○ | 757 | ○ | 762 |
| 15* | 725 | 50.0 | ○ | 847 | ○ | 852 | ○ | 848 | ○ | 853 |
| 16* | 754 | 51.4 | ○ | 899 | ○ | 904 | ○ | 901 | ○ | 906 |
| 17* | 586 | 91.5 | ○ | 484 | ○ | 489 | ○ | 486 | ○ | 501 |
| 18* | 642 | 63.5 | ○ | 790 | ○ | 796 | ○ | 797 | ○ | 802 |
| 19* | 653 | 66.8 | ○ | 813 | ○ | 819 | ○ | 817 | ○ | 822 |
| 20* | 732 | 70.0 | ○ | 487 | ○ | 491 | ○ | 490 | ○ | 494 |
| 21* | 636 | 65.1 | ○ | 837 | ○ | 842 | ○ | 840 | ○ | 845 |
| 22* | 580 | 65.1 | ○ | 526 | ○ | 531 | ○ | 531 | ○ | 536 |
| 23* | 586 | 53.2 | ○ | 870 | ○ | 875 | ○ | 877 | ○ | 832 |
| 24* | 668 | 59.6 | ○ | 893 | ○ | 898 | ○ | 896 | ○ | 902 |
| 25* | 780 | 82.6 | ○ | 785 | ○ | 790 | ○ | 791 | ○ | 796 |

TABLE 7 (2)-continued

| | | | | | | | | | | |
|---|---|---|---|---|---|---|---|---|---|---|
| 26* | 563 | 56.3 | ○ | 838 | ○ | 843 | ○ | 843 | ○ | 848 |
| 27* | 569 | 58.7 | ○ | 858 | ○ | 863 | ○ | 860 | ○ | 865 |
| 28* | 710 | 75.6 | ○ | 807 | ○ | 812 | ○ | 818 | ○ | 823 |
| 29* | 738 | 55.0 | ○ | 851 | ○ | 856 | ○ | 852 | ○ | 857 |
| 30* | 660 | 63.5 | ○ | 798 | ○ | 804 | ○ | 801 | ○ | 806 |
| 31* | 658 | 54.5 | ○ | 839 | ○ | 945 | ○ | 942 | ○ | 948 |
| 32* | 653 | 58.8 | ○ | 938 | ○ | 943 | ○ | 941 | ○ | 946 |
| 33# | 660 | 70.1 | ○ | 353 | x | 365 | ○ | 364 | x | 370 |
| 34# | 545 | 56.8 | x | 759 | x | 780 | x | 773 | x | 778 |
| 35# | 715 | 60.4 | x | 818 | x | 823 | x | 820 | x | 825 |
| 36# | 524 | 65.0 | x | 648 | x | 653 | ○ | 654 | x | 663 |
| 37# | 714 | 85.5 | ○ | 340 | ○ | 345 | ○ | 364 | ○ | 352 |

| Sample | Hot rolled steel sheet | | Cold rolled steel sheet | |
|---|---|---|---|---|
| No. | LDR | Hv | LDR | Hv |
| 1* | 2.07 | 422 | 2.09 | 425 |
| 2* | 2.06 | 572 | 2.07 | 583 |
| 3* | 2.05 | 681 | 2.06 | 682 |
| 4* | 2.07 | 410 | 2.09 | 411 |
| 5* | 2.03 | 665 | 2.05 | 683 |
| 6* | 2.06 | 461 | 2.08 | 475 |
| 7* | 2.01 | 701 | 2.02 | 708 |
| 8* | 2.00 | 759 | 2.02 | 762 |
| 9* | 2.02 | 753 | 2.03 | 754 |
| 10* | 2.01 | 820 | 2.03 | 821 |
| 11* | 2.00 | 842 | 2.02 | 843 |
| 12* | 2.02 | 753 | 2.03 | 764 |
| 13* | 2.00 | 817 | 2.02 | 819 |
| 14* | 2.01 | 751 | 2.03 | 762 |
| 15* | 2.01 | 852 | 2.02 | 853 |
| 16* | 2.00 | 904 | 2.01 | 906 |
| 17* | 2.06 | 489 | 2.08 | 501 |
| 18* | 2.03 | 796 | 2.04 | 802 |
| 19* | 2.02 | 819 | 2.03 | 822 |
| 20* | 2.06 | 491 | 2.08 | 494 |
| 21* | 2.04 | 842 | 2.07 | 845 |
| 22* | 2.05 | 531 | 2.07 | 536 |
| 23* | 2.04 | 875 | 2.06 | 882 |
| 24* | 2.03 | 898 | 2.05 | 902 |
| 25* | 2.06 | 790 | 2.08 | 796 |
| 26* | 2.04 | 843 | 2.06 | 648 |
| 27* | 2.03 | 863 | 2.05 | 865 |
| 28* | 2.02 | 812 | 2.03 823 | |
| 29* | 2.00 | 856 | 2.02 | 857 |
| 30* | 2.02 | 804 | 2.04 | 806 |
| 31* | 2.01 | 945 | 2.03 | 948 |
| 32* | 2.00 | 943 | 2.03 | 946 |
| 33# | 1.92 | 365 | 1.97 | 370 |
| 34# | 1.80 | 780 | 1.82 | 778 |
| 35# | 1.85 | 823 | 1.86 | 825 |
| 36# | 1.89 | 653 | 1.93 | 663 |
| 37# | 2.05 | 345 | 2.08 | 352 |

Note:
*: stee1 of invention
#: steel of comparative example
○: steel sheet being formable, x: steel sheet being not formable

TABLE 8 (1)

| S. | Chemical composition (wt. %) | | | | | | | | | | |
|---|---|---|---|---|---|---|---|---|---|---|---|
| No. | C** | Si | Mn | P | N | Cr | Al | V | Ti | Nb | B |
| 1* | 24 | 0.010 | 0.150 | 0.030 | 0.0002 | 0.840 | 0.120 | — | — | — | — |
| 2* | 55 | 0.012 | 0.130 | 0.012 | 0.0018 | 0.855 | 1.833 | — | — | — | — |
| 3* | 58 | 0.030 | 0.142 | 0.015 | 0.0052 | 0.841 | 0.020 | 0.12 | — | — | — |
| 4* | 13 | 0.302 | 0.301 | 0.005 | 0.0033 | 1.063 | 0.033 | 0.95 | — | — | — |
| 5* | 35 | 0.211 | 0.650 | 0.008 | 0.0054 | 0.951 | 0.134 | 0.11 | — | — | — |
| 6* | 21 | 0.605 | 1.232 | 0.006 | 0.0026 | 0.869 | 1.766 | 0.96 | — | — | — |
| 7* | 33 | 0.022 | 0.236 | 0.012 | 0.0041 | 3.042 | 0.132 | — | — | — | — |
| 8* | 45 | 0.050 | 1.120 | 0.012 | 0.0053 | 3.540 | 1.925 | — | — | — | — |
| 9* | 32 | 0.018 | 0.450 | 0.038 | 0.0025 | 4.615 | 0.042 | 0.16 | — | — | — |
| 10* | 49 | 0.022 | 0.780 | 0.012 | 0.0034 | 4.415 | 0.033 | 0.89 | — | — | — |

TABLE 8 (1)-continued

| S. | Chemical composition (wt. %) | | | | | | | | | | |
|---|---|---|---|---|---|---|---|---|---|---|---|
| No. | C** | Si | Mn | P | N | Cr | Al | V | Ti | Nb | B |
| 11* | 16 | 0.035 | 0.822 | 0.011 | 0.0034 | 3.811 | 0.125 | 0.19 | — | — | — |
| 12* | 22 | 0.046 | 0.266 | 0.014 | 0.0069 | 2.851 | 1.641 | 0.79 | — | — | — |
| 13* | 78 | 0.201 | 2.772 | 0.009 | 0.0044 | 0.821 | 0.115 | — | 0.02 | — | — |
| 14* | 13 | 0.015 | 0.653 | 0.012 | 0.0025 | 0.856 | 1.830 | — | 0.78 | — | — |
| 15* | 52 | 0.022 | 2.254 | 0.013 | 0.0056 | 0.939 | 0.025 | 0.14 | 0.05 | — | — |
| 16* | 43 | 0.036 | 0.302 | 0.004 | 0.0039 | 1.065 | 0.031 | 0.99 | 0.82 | — | — |
| 17* | 52 | 0.322 | 0.265 | 0.024 | 0.0035 | 0.954 | 0.134 | 0.11 | 0.12 | — | — |
| 18* | 56 | 0.352 | 0.523 | 0.032 | 0.0067 | 0.871 | 1.756 | 0.90 | 0.72 | — | — |
| 19* | 15 | 0.655 | 0.366 | 0.057 | 0.0052 | 3.020 | 0.101 | — | 0.22 | — | — |
| 20* | 59 | 0.022 | 0.296 | 0.026 | 0.0012 | 3.480 | 1.960 | — | 0.62 | — | — |
| 21* | 56 | 0.017 | 1.275 | 0.085 | 0.0043 | 4.511 | 0.043 | 0.13 | 0.25 | — | — |
| 22* | 82 | 0.304 | 0.778 | 0.056 | 0.0036 | 4.411 | 0.035 | 0.92 | 0.66 | — | — |
| 23* | 34 | 0.021 | 1.323 | 0.074 | 0.0045 | 3.862 | 0.150 | 0.16 | 0.15 | — | — |
| 24* | 10 | 0.010 | 0.302 | 0.005 | 0.0034 | 2.862 | 1.643 | 0.78 | 0.85 | - — | — |
| 25* | 9 | 0.011 | 0.148 | 0.032 | 0.0005 | 0.842 | 0.115 | — | — | 0.007 | — |
| 26* | 24 | 0.013 | 0.125 | 0.011 | 0.0016 | 0.954 | 1.830 | — | — | 0.020 | — |
| 27 | 62 | 0.029 | 0.130 | 0.014 | 0.0061 | 0.840 | 0.022 | 0.13 | — | 0.054 | — |
| 28* | 15 | 0.305 | 0.290 | 0.007 | 0.0035 | 0.865 | 0.035 | 0.92 | — | 0.013 | — |
| 29* | 37 | 0.214 | 0.620 | 0.009 | 0.0051 | 0.819 | 0.180 | 0.12 | — | 0.031 | — |
| 30* | 58 | 0.615 | 1.205 | 0.007 | 0.0022 | 1.068 | 1.775 | 0.95 | — | 0.056 | — |

Note:
S. No. = Sample No.
*: steel of invention
**: C content in terms of ppm

TABLE 8 (2)

| S. | Chemical composition (wt. %) | | | | | | | | | | |
|---|---|---|---|---|---|---|---|---|---|---|---|
| No. | C** | Si | Mn | P | N | Cr | Al | V | Ti | Nb | B |
| 31* | 31 | 0.020 | 0.248 | 0.013 | 0.0045 | 3.055 | 0.133 | — | — | 0.025 | — |
| 32* | 82 | 0.051 | 1.152 | 0.013 | 0.0043 | 3.532 | 1.930 | — | — | 0.058 | — |
| 33* | 30 | 0.016 | 0.453 | 0.039 | 0.0031 | 4.656 | 0.045 | 0.14 | — | 0.025 | — |
| 34* | 51 | 0.025 | 0.786 | 0.015 | 0.0032 | 4.455 | 0.032 | 0.88 | — | 0.040 | — |
| 35* | 14 | 0.033 | 0.825 | 0.012 | 0.0034 | 3.861 | 0.123 | 0.16 | — | 0.010 | — |
| 36* | 25 | 0.041 | 0.276 | 0.015 | 0.0065 | 2.851 | 1.645 | 0.75 | — | 0.021 | — |
| 37* | 88 | 0.205 | 0.765 | 0.010 | 0.0041 | 0.822 | 0.116 | — | 0.02 | 0.059 | — |
| 38* | 14 | 0.014 | 0.662 | 0.013 | 0.0023 | 0.851 | 1.835 | — | 0.73 | 0.014 | — |
| 39* | 70 | 0.025 | 2.250 | 0.015 | 0.0055 | 0.938 | 0.024 | 0.13 | 0.04 | 0.033 | — |
| 40* | 23 | 0.041 | 0.332 | 0.005 | 0.0041 | 0.864 | 0.033 | 0.98 | 0.80 | 0.010 | — |
| 41* | 51 | 0.320 | 0.250 | 0.022 | 0.0037 | 0.850 | 0.143 | 0.14 | 0.01 | 0.041 | — |
| 42* | 67 | 0.360 | 0.545 | 0.031 | 0.0062 | 0.879 | 1.730 | 0.93 | 0.71 | 0.043 | — |
| 43* | 17 | 0.643 | 0.335 | 0.060 | 0.0051 | 3.065 | 0.120 | — | 0.28 | 0.013 | — |
| 44* | 58 | 0.025 | 0.299 | 0.028 | 0.0011 | 3.492 | 1.970 | — | 0.59 | 0.048 | — |
| 45* | 25 | 0.013 | 1.256 | 0.084 | 0.0042 | 4.605 | 0.044 | 0.11 | 0.24 | 0.016 | — |
| 46* | 44 | 0.315 | 0.785 | 0.057 | 0.0037 | 4.432 | 0.038 | 0.95 | 0.63 | 0.035 | — |
| 47* | 27 | 0.022 | 1.395 | 0.075 | 0.0045 | 3.826 | 0.155 | 0.17 | 0.19 | 0.024 | — |
| 48* | 16 | 0.011 | 0.356 | 0.010 | 0.0036 | 2.796 | 1.650 | 0.79 | 0.92 | 0.012 | — |
| 49* | 32 | 0.029 | 0.152 | 0.015 | 0.0053 | 0.940 | — | 0.11 | — | — | — |
| 50* | 11 | 0.315 | 0.320 | 0.006 | 0.0034 | 0.864 | — | 0.96 | — | — | — |
| 51* | 35 | 0.012 | 0.430 | 0.039 | 0.0028 | 4.652 | — | 0.12 | — | — | — |
| 52* | 48 | 0.030 | 0.765 | 0.013 | 0.0035 | 4.432 | — | 0.91 | — | — | — |
| 53* | 30 | 0.022 | 2.252 | 0.012 | 0.0058 | 0.838 | — | 0.12 | 0.04 | — | — |
| 54* | 25 | 0.035 | 0.315 | 0.006 | 0.0035 | 0.364 | — | 0.98 | 0.83 | — | — |
| 55* | 28 | 0.015 | 1.263 | 0.082 | 0.0042 | 4.618 | — | 0.14 | 0.12 | — | — |
| 56* | 80 | 0.382 | 0.751 | 0.058 | 0.0037 | 4.415 | — | 0.98 | 0.76 | — | — |
| 57* | 31 | 0.019 | 0.115 | 0.015 | 0.0050 | 0.841 | — | 0.12 | — | 0.024 | — |
| 58* | 14 | 0.320 | 0.235 | 0.004 | 0.0036 | 0.967 | — | 0.98 | — | 0.013 | — |
| 59* | 32 | 0.015 | 0.480 | 0.035 | 0.0030 | 4.655 | — | 0.05 | — | 0.025 | — |
| 60* | 49 | 0.024 | 0.760 | 0.016 | 0.0038 | 4.464 | — | 0.83 | — | 0.040 | — |

Note:
S. No. = Sample No.
*: steel of invention
**: C content in terms of ppm

TABLE 8 (3)

| S. | Chemical composition (wt. %) | | | | | | | | | | |
|---|---|---|---|---|---|---|---|---|---|---|---|
| No. | C** | Si | Mn | P | N | Cr | Al | V | Ti | Nb | B |
| 61* | 72 | 0.028 | 0.225 | 0.014 | 0.0056 | 0.840 | — | 0.12 | 0.03 | 0.033 | — |
| 62* | 20 | 0.040 | 0.345 | 0.008 | 0.0039 | 0.954 | — | 0.97 | 0.85 | 0.010 | — |
| 63* | 21 | 0.015 | 1.242 | 0.082 | 0.0042 | 4.322 | — | 0.12 | 0.06 | 0.016 | — |
| 64* | 22 | 0.316 | 0.784 | 0.058 | 0.0038 | 4.324 | — | 0.96 | 0.93 | 0.016 | — |
| 65* | 49 | 0.320 | 0.265 | 0.034 | 0.0036 | 0.855 | 0.125 | 0.10 | 0.10 | — | 0.0006 |
| 66* | 40 | 0.342 | 0.523 | 0.022 | 0.0068 | 0.905 | 1.708 | 0.95 | 0.78 | — | 0.0048 |
| 67* | 33 | 0.022 | 1.323 | 0.075 | 0.0044 | 3.850 | 0.146 | 0.12 | 0.14 | — | 0.0035 |
| 68* | 18 | 0.011 | 0.302 | 0.006 | 0.0032 | 2.769 | 1.608 | 0.81 | 0.83 | — | 0.0026 |
| 69* | 50 | 0.322 | 0.263 | 0.023 | 0.0036 | 0.854 | 0.134 | 0.11 | 0.01 | 0.042 | 0.0031 |
| 70* | 45 | 0.352 | 0.535 | 0.033 | 0.0068 | 0.871 | 1.756 | 0.90 | 0.72 | 0.030 | 0.0029 |
| 71* | 32 | 0.021 | 1.305 | 0.076 | 0.0044 | 3.862 | 0.150 | 0.16 | 0.12 | 0.023 | 0.0010 |
| 72* | 15 | 0.010 | 0.314 | 0.006 | 0.0031 | 2.862 | 1.643 | 0.78 | 0.84 | 0.012 | 0.0019 |
| 73* | 69 | 0.021 | 2.541 | 0.013 | 0.0048 | 0.909 | — | 0.13 | 0.03 | — | 0.0030 |
| 74* | 42 | 0.363 | 0.568 | 0.059 | 0.0045 | 4.300 | — | 0.97 | 0.86 | — | 0.0008 |
| 75* | 75 | 0.029 | 2.560 | 0.015 | 0.0033 | 0.822 | — | 0.16 | 0.05 | 0.032 | 0.0048 |
| 76* | 61 | 0.302 | 0.018 | 0.061 | 0.0036 | 4.385 | — | 0.98 | 0.94 | 0.048 | 0.0015 |
| 77# | 275+ | 0.073 | 1.665 | 0.021 | 0.0044 | 6.069 | 0.035+ | — | — | — | — |
| 78# | 64 | 0.648 | 0.323 | 0.065 | 0.0035 | 0.845 | 3.250+ | — | — | — | |
| 79# | 32 | 0.354 | 0.321 | 0.011 | 0.0023 | 0.953 | 0.044+ | 1.59+ | — | — | — |
| 80# | 62 | 0.021 | 0.121 | 0.021 | 0.0010 | 0.862 | 0.062+ | — | 1.85+ | 0.050 | — |
| 81# | 45 | 0.351 | 1.513 | 0.009 | 0.0030 | 0.125+ | 0.065 | 0.02 | 0.012 | — | — |
| 82# | 962+ | 0.024 | 0.532 | 0.012 | 0.0018 | 0.323 | 0.033+ | 0.01 | 0.005 | — | — |

Note:
S. No. = Sample No.
*: steel of invention
#: steel of comparative example
**: C content in terms of ppm
+: the component being out of the range of the present invention

TABLE 8 (4)

| | Coil- | Reduction | Hot rolled steel sheet | | | | Cold rolled steel sheet | | | |
|---|---|---|---|---|---|---|---|---|---|---|
| | ing | in cold | Drawing 2.0 | | Drawing 2.1 | | Drawing 2.0 | | Drawing 2.1 | |
| Sample No. | temp. (°C.) | rolling (%) | Form-ing | Hv | Form-ing | Hv | Form-ing | Hv | Form-ing | Hv |
| 1* | 720 | 80.0 | ○ | 413 | ○ | 418 | ○ | 417 | ○ | 423 |
| 2* | 660 | 75.0 | ○ | 750 | ○ | 755 | ○ | 756 | ○ | 762 |
| 3* | 725 | 80.5 | ○ | 425 | ○ | 432 | ○ | 442 | ○ | 448 |
| 4* | 551 | 59.2 | ○ | 663 | ○ | 671 | ○ | 570 | ○ | 676 |
| 5* | 633 | 60.3 | ○ | 481 | ○ | 490 | ○ | 491 | ○ | 499 |
| 6* | 510 | 51.9 | ○ | 310 | ○ | 821 | ○ | 818 | ○ | 825 |
| 7* | 605 | 70.5 | ○ | 804 | ○ | 814 | ○ | 806 | ○ | 815 |
| 8* | 550 | 56.8 | ○ | 850 | ○ | 858 | ○ | 858 | ○ | 864 |
| 9* | 707 | 70.7 | ○ | 735 | ○ | 746 | ○ | 747 | ○ | 754 |
| 10* | 543 | 59.9 | ○ | 734 | ○ | 746 | ○ | 742 | ○ | 753 |
| 11* | 720 | 80.0 | ○ | 806 | ○ | 812 | ○ | 813 | ○ | 820 |
| 12* | 750 | 55.0 | ○ | 852 | ○ | 864 | ○ | 862 | ○ | 875 |
| 13* | 722 | 80.0 | ○ | 447 | ○ | 458 | ○ | 451 | ○ | 562 |
| 14* | 665 | 75.0 | ○ | 836 | ○ | 845 | ○ | 851 | ○ | 858 |
| 15* | 725 | 80.5 | ○ | 460 | ○ | 467 | ○ | 463 | ○ | 472 |
| 16* | 564 | 59.2 | ○ | 753 | ○ | 760 | ○ | 765 | ○ | 771 |
| 17* | 635 | 60.3 | ○ | 526 | ○ | 533 | ○ | 536 | ○ | 544 |
| 18* | 515 | 51.9 | ○ | 887 | ○ | 894 | ○ | 894 | ○ | 902 |
| 19* | 602 | 70.5 | ○ | 851 | ○ | 856 | ○ | 861 | ○ | 867 |
| 20* | 551 | 56.8 | ○ | 926 | ○ | 932 | ○ | 937 | ○ | 941 |
| 21* | 717 | 70.7 | ○ | 811 | ○ | 819 | ○ | 822 | ○ | 832 |
| 22* | 523 | 59.9 | ○ | 899 | ○ | 906 | ○ | 903 | ○ | 912 |
| 23* | 750 | 80.0 | ○ | 862 | ○ | 874 | ○ | 872 | ○ | 688 |
| 24* | 825 | 55.0 | ○ | 930 | ○ | 941 | ○ | 936 | ○ | 943 |
| 25* | 680 | 80.0 | ○ | 415 | ○ | 421 | ○ | 428 | ○ | 436 |
| 26* | 695 | 65.5 | ○ | 753 | ○ | 768 | ○ | 767 | ○ | 775 |
| 27* | 802 | 86.7 | ○ | 441 | ○ | 451 | ○ | 454 | ○ | 476 |
| 28* | 706 | 79.1 | ○ | 669 | ○ | 680 | ○ | 681 | ○ | 687 |
| 29* | 730 | 90.5 | ○ | 467 | ○ | 472 | ○ | 476 | ○ | 484 |
| 30* | 793 | 90.3 | ○ | 811 | ○ | 817 | ○ | 823 | ○ | 832 |

TABLE 8 (4)-continued

| Sample | Hot rolled steel sheet | | Cold rolled steel sheet | |
|---|---|---|---|---|
| No. | LDR | Hv | LDR | Hv |
| 1* | 2.19 | 418 | 2.25 | 423 |
| 2* | 2.12 | 755 | 2.14 | 762 |
| 3* | 2.18 | 432 | 2.24 | 448 |
| 4* | 2.15 | 671 | 2.17 | 676 |
| 5* | 2.17 | 490 | 2.19 | 499 |
| 6* | 2.11 | 821 | 2.14 | 825 |
| 7* | 2.11 | 814 | 2.13 | 815 |
| 8* | 2.10 | 858 | 2.12 | 864 |
| 9* | 2.12 | 746 | 2.14 | 754 |
| 10* | 2.10 | 746 | 2.13 | 753 |
| 11* | 2.16 | 812 | 2.18 | 820 |
| 12* | 2.14 | 864 | 2.16 | 975 |
| 13* | 2.19 | 458 | 2.25 | 462 |
| 14* | 2.14 | 845 | 2.17 | 858 |
| 15* | 2.18 | 457 | 2.24 | 472 |
| 16* | 2.10 | 760 | 2.13 | 771 |
| 17* | 2.15 | 533 | 2.19 | 544 |
| 18* | 2.13 | 834 | 2.16 | 902 |
| 19* | 2.12 | 856 | 2.14 | 867 |
| 20* | 2.10 | 932 | 2.12 | 941 |
| 21* | 2.11 | 819 | 2.13 | 832 |
| 22* | 2.10 | 906 | 2.11 | 912 |
| 23* | 2.12 | 874 | 2.14 | 888 |
| 24* | 2.10 | 941 | 2.13 | 543 |
| 25* | 2.21 | 421 | 2.26 | 436 |
| 26* | 2.17 | 468 | 2.19 | 775 |
| 27* | 2.21 | 451 | 2.25 | 476 |
| 28* | 2.19 | 680 | 2.21 | 687 |
| 29* | 2.20 | 472 | 2.22 | 484 |
| 30* | 2.16 | 817 | 2.19 | 832 |

Note:
*: steel of invention
○: steel sheet being formable

TABLE 8 (5)

| | Coil- | Reduction | Hot rolled steel sheet | | | | Cold rolled steel sheet | | | |
|---|---|---|---|---|---|---|---|---|---|---|
| | ing | in cold | Drawing 2.0 | | Drawing 2.1 | | Drawing 2.0 | | Drawing 2.1 | |
| Sample No. | temp. (°C.) | rolling (%) | Form-ing | Hv | Form-ing | Hv | Form-ing | Hv | Form-ing | Hv |
| 31* | 752 | 82.5 | ○ | 808 | ○ | 814 | ○ | 816 | ○ | 823 |
| 32* | 630 | 64.3 | ○ | 849 | ○ | 855 | ○ | 852 | ○ | 860 |
| 33* | 605 | 75.3 | ○ | 745 | ○ | 758 | ○ | 756 | ○ | 762 |
| 34* | 651 | 56.3 | ○ | 732 | ○ | 741 | ○ | 742 | ○ | 750 |
| 35* | 723 | 68.6 | ○ | 813 | ○ | 822 | ○ | 819 | ○ | 828 |
| 36* | 730 | 60.8 | ○ | 849 | ○ | 861 | ○ | 866 | ○ | 875 |
| 37* | 703 | 77.5 | ○ | 448 | ○ | 460 | ○ | 458 | ○ | 463 |
| 38* | 680 | 73.5 | ○ | 831 | ○ | 837 | ○ | 840 | ○ | 845 |
| 39* | 683 | 75.0 | ○ | 460 | ○ | 458 | ○ | 487 | ○ | 475 |
| 40* | 584 | 60.3 | ○ | 751 | ○ | 760 | ○ | 759 | ○ | 766 |
| 41* | 664 | 66.8 | ○ | 419 | ○ | 529 | ○ | 523 | ○ | 530 |
| 42* | 631 | 71.1 | ○ | 884 | ○ | 895 | ○ | 892 | ○ | 900 |
| 43* | 554 | 56.6 | ○ | 835 | ○ | 849 | ○ | 846 | ○ | 856 |
| 44* | 515 | 50.3 | ○ | 923 | ○ | 938 | ○ | 933 | ○ | 939 |
| 45* | 532 | 56.9 | ○ | 805 | ○ | 813 | ○ | 810 | ○ | 814 |
| 46* | 512 | 56.7 | ○ | 898 | ○ | 906 | ○ | 902 | ○ | 910 |
| 47* | 540 | 67.8 | ○ | 863 | ○ | 868 | ○ | 865 | ○ | 871 |
| 48* | 581 | 60.3 | ○ | 932 | ○ | 941 | ○ | 936 | ○ | 945 |
| 49* | 604 | 74.3 | ○ | 426 | ○ | 435 | ○ | 448 | ○ | 448 |
| 50* | 649 | 56.4 | ○ | 665 | ○ | 674 | ○ | 665 | ○ | 675 |
| 51* | 732 | 67.7 | ○ | 735 | ○ | 742 | ○ | 740 | ○ | 750 |
| 52* | 703 | 60.5 | ○ | 735 | ○ | 745 | ○ | 737 | ○ | 747 |
| 53* | 713 | 77.4 | ○ | 453 | ○ | 464 | ○ | 474 | ○ | 482 |
| 54* | 675 | 72.3 | ○ | 756 | ○ | 765 | ○ | 769 | ○ | 781 |
| 55* | 683 | 75.2 | ○ | 811 | ○ | 818 | ○ | 826 | ○ | 832 |
| 56* | 574 | 61.4 | ○ | 891 | ○ | 901 | ○ | 895 | ○ | 902 |
| 57* | 666 | 66.4 | ○ | 447 | ○ | 455 | ○ | 450 | ○ | 456 |
| 58* | 635 | 71.2 | ○ | 680 | ○ | 685 | ○ | 683 | ○ | 691 |

TABLE 8 (5)-continued

| | | | | | | | | | | |
|---|---|---|---|---|---|---|---|---|---|---|
| 59* | 553 | 56.7 | ○ | 745 | ○ | 756 | ○ | 748 | ○ | 756 |
| 60* | 514 | 50.4 | ○ | 740 | ○ | 747 | ○ | 746 | ○ | 749 |

| Sample | Hot rolled steel sheet | | Cold rolled steel sheet | |
|---|---|---|---|---|
| No. | LDR | Hv | LDR | Hv |
| 31* | 2.16 | 814 | 2.18 | 823 |
| 32* | 2.14 | 855 | 2.16 | 860 |
| 33* | 2.16 | 756 | 2.18 | 762 |
| 34* | 2.14 | 741 | 2.15 | 750 |
| 35* | 2.20 | 822 | 2.22 | 828 |
| 36* | 2.18 | 861 | 2.19 | 875 |
| 37* | 2.20 | 460 | 2.21 | 463 |
| 38* | 2.18 | 837 | 2.20 | 845 |
| 39* | 2.20 | 468 | 2.22 | 475 |
| 40* | 2.14 | 760 | 2.16 | 765 |
| 41* | 2.19 | 529 | 2.22 | 530 |
| 42* | 2.17 | 855 | 2.19 | 900 |
| 43* | 2.14 | 849 | 2.16 | 855 |
| 44* | 2.12 | 938 | 2.15 | 539 |
| 45* | 2.13 | 813 | 2.15 | 814 |
| 46* | 2.12 | 906 | 2.14 | 910 |
| 47* | 2.14 | 858 | 2.16 | 871 |
| 48* | 2.12 | 941 | 2.14 | 945 |
| 49* | 2.17 | 435 | 2.23 | 448 |
| 50* | 2.16 | 674 | 2.17 | 675 |
| 51* | 2.13 | 742 | 2.14 | 750 |
| 52* | 2.11 | 745 | 2.12 | 747 |
| 53* | 2.19 | 464 | 2.23 | 482 |
| 54* | 2.11 | 765 | 2.14 | 781 |
| 55* | 2.12 | 818 | 2.14 | 832 |
| 56* | 2.11 | 901 | 2.12 | 902 |
| 57* | 2.22 | 455 | 2.25 | 456 |
| 58* | 2.18 | 685 | 2.21 | 691 |
| 59* | 2.16 | 755 | 2.19 | 756 |
| 60* | 2.13 | 747 | 2.15 | 749 |

Note:
*: steel of invention
○: steel sheet being formable

TABLE 8 (6)

| Sample | Coiling temp. | Reduction in cold rolling | Hot rolled steel sheet | | | | Cold rolled steel sheet | | | | Hot rolled steel sheet | | Cold rolled steel sheet | |
|---|---|---|---|---|---|---|---|---|---|---|---|---|---|---|
| | | | Drawing 2.0 | | Drawing 2.1 | | Drawing 2.0 | | Drawing 2.1 | | | | | |
| No. | (°C.) | (%) | Forming | Hv | Forming | Hv | Forming | Hv | Forming | Hv | LDR | Hv | LDR | Hv |
| 61* | 536 | 57.0 | ○ | 452 | ○ | 465 | ○ | 459 | ○ | 466 | 2.21 | 465 | 2.23 | 466 |
| 62* | 514 | 57.7 | ○ | 751 | ○ | 762 | ○ | 760 | ○ | 765 | 2.15 | 762 | 2.16 | 765 |
| 63* | 545 | 64.8 | ○ | 790 | ○ | 810 | ○ | 803 | ○ | 811 | 2.14 | 810 | 2.16 | 811 |
| 64* | 582 | 61.3 | ○ | 900 | ○ | 904 | ○ | 902 | ○ | 908 | 2.12 | 904 | 2.13 | 908 |
| 65* | 530 | 65.2 | ○ | 526 | ○ | 533 | ○ | 529 | ○ | 536 | 2.16 | 533 | 2.19 | 536 |
| 66* | 621 | 56.5 | ○ | 886 | ○ | 891 | ○ | 891 | ○ | 898 | 2.13 | 891 | 2.14 | 898 |
| 67* | 586 | 71.2 | ○ | 854 | ○ | 862 | ○ | 868 | ○ | 876 | 2.12 | 862 | 2.14 | 876 |
| 68* | 614 | 71.6 | ○ | 925 | ○ | 933 | ○ | 935 | ○ | 945 | 2.11 | 933 | 2.13 | 945 |
| 69* | 732 | 80.3 | ○ | 542 | ○ | 542 | ○ | 554 | ○ | 586 | 2.16 | 542 | 2.19 | 586 |
| 70* | 821 | 65.3 | ○ | 888 | ○ | 868 | ○ | 892 | ○ | 901 | 2.12 | 898 | 2.15 | 901 |
| 71* | 786 | 68.1 | ○ | 863 | ○ | 871 | ○ | 862 | ○ | 875 | 2.12 | 871 | 2.14 | 875 |
| 72* | 535 | 70.3 | ○ | 936 | ○ | 945 | ○ | 948 | ○ | 956 | 2.11 | 945 | 2.13 | 956 |
| 73* | 688 | 81.9 | ○ | 454 | ○ | 465 | ○ | 456 | ○ | 478 | 2.18 | 456 | 2.21 | 478 |
| 74* | 531 | 60.2 | ○ | 891 | ○ | 901 | ○ | 900 | ○ | 906 | 2.11 | 901 | 2.13 | 906 |
| 75* | 726 | 89.3 | ○ | 462 | ○ | 468 | ○ | 478 | ○ | 490 | 2.20 | 458 | 2.22 | 490 |
| 76* | 756 | 56.3 | ○ | 903 | ○ | 910 | ○ | 905 | ○ | 912 | 2.11 | 910 | 2.13 | 912 |
| 77# | 563 | 63.2 | x | 760 | x | 770 | x | 763 | x | 772 | 1.82 | 770 | 1.84 | 772 |
| 78# | 635 | 52.0 | x | 762 | x | 771 | x | 763 | x | 771 | 1.87 | 771 | 1.89 | 771 |
| 79# | 563 | 58.6 | x | 650 | x | 655 | x | 648 | x | 649 | 1.91 | 655 | 1.93 | 649 |
| 80# | 623 | 50.1 | x | 821 | x | 827 | x | 811 | x | 815 | 1.84 | 827 | 1.87 | 815 |

TABLE 8 (6)-continued

| Sample No. | Coiling temp. (°C.) | Reduction in cold rolling (%) | Hot rolled steel sheet Drawing 2.0 Forming | Hv | Drawing 2.1 Forming | Hv | Cold rolled steel sheet Drawing 2.0 Forming | Hv | Drawing 2.1 Forming | Hv | Hot rolled steel sheet LDR | Hv | Cold rolled steel sheet LDR | Hv |
|---|---|---|---|---|---|---|---|---|---|---|---|---|---|---|
| 81# | 750 | 85.2 | ○ | 343 | ○ | 355 | ○ | 353 | ○ | 360 | 2.15 | 355 | 2.17 | 360 |
| 82# | 680 | 79.3 | x | 336 | x | 364 | x | 362 | x | 368 | 1.93 | 364 | 1.99 | 368 |

Note:
*: steel of invention
#: steel of comparative example
○: steel sheet being formable,
x steel sheet being not formable

POSSIBILITY OF UTILIZATION IN THE INDUSTRY

The present invention can provide a steel sheet having high susceptibility to nitriding and excellent deep drawability. The steel sheet can be nitrided efficiently to have a desired depth in a short period of nitriding time using a short nitriding furnace. The steel sheet is, therefore, excellent in productivity. Moreover, since tools, parts for machine structures, automobile parts, and the like having wear resistance, fatigue strength and seizure resistance can be produced from the press formed articles of the present invention, the possibility of utilizing the present invention in the industry is enormous.

We claim:

1. A steel for press forming having excellent formability and susceptibility to nitriding, comprising, based on weight, 0.01 to less than 0.08% of C, 0.005 to 1.00% of Si, 0.010 to 3.00% of Mn, 0.001 to 0.150% of P, 0.0002 to 0.0100% of N, greater than 0.15 to 5.00% of Cr, greater than 0.060 to 2.00% of Al, 0.010% to less than 4C (in percent) of Ti and 0.010 to 1.00% of V, and the balance Fe and unavoidable impurities.

2. A steel for press forming having excellent formability and susceptibility to nitriding, comprising, based on weight, 0.0002 to less than 0.0100% of C, 0.005 to 1.00% of Si, 0.010 to 3.00% of Mn, 0.001 to 0.150% of P, 0.0002 to 0.0100% of N, greater than 0.80 to 5.00% of Cr, one or at least two elements selected from the nitriding hardening element group consisting of greater than 0.10 to 1.00% of V, greater than 0.10 to 2.00% of Al and 0.010 to 1.00% of Ti, and the balance Fe and unavoidable impurities.

3. The steel according to claim 2, wherein the steel further contains one or two elements selected from 0.005 to 0.060% of Nb and 0.0005 to 0.0050% of B.

4. A press formed article forming a hard nitride layer at least on one side after press forming a steel sheet, which comprises, based on weight, 0.01 to less than 0.08% of C, 0.005 to 1.00% of Si, 0.010 to 3.00% of Mn, 0.001 to 0.150% of P, 0.0002 to 0.0100% of N, greater than 0.15 to 5.00% of Cr, greater than 0.060 to 2.00% of Al, 0.010% to less than 4C (in percent) of Ti and 0.010 to 1.00% of V, and the balance Fe and unavoidable impurities, the press formed article forming the hard nitride layer having a micro Vickers hardness of at least about 400.

5. The press formed article according to claim 4, wherein the steel sheet is a hot rolled or cold rolled steel sheet.

6. A press formed article forming a hard nitride layer at least on one side after press forming a steel sheet, which comprises, based on weight, 0.0002 to less than 0.0100% of C, 0.005 to 1.00% of Si, 0.010 to 3.00% of Mn, 0.001 to 0.150% of P, 0.0002 to 0.0100% of N, greater than 0.80 to 5.00% of Cr, one or at least two elements selected from the nitriding hardening element group consisting of greater than 0.10 to 1.00% of V, greater than 0.10 to 2.00% of Al and 0.010% to 1.00% of Ti, and the balance Fe and unavoidable impurities, the press formed article forming the hard nitride layer having a micro Vickers hardness of at least about 400.

7. The press formed article according to claim 6, wherein the steel sheet further contains, based on weight, one or two elements selected from 0.005 to 0.060% of Nb and 0.0005 to 0.0050% of B.

8. The press formed article according to claim 6, wherein the steel sheet is a hot rolled or cold rolled steel sheet.

9. The nitriding steel according to claim 1, wherein the range of the upper limit value of Ti and V being contained in the steel is as follows $$C>(12/48)\cdot Ti+(12/51)\cdot(3/4)\cdot V.$$

10. The press formed article according to claim 4, wherein the range of the upper limit value of Ti and V being contained in the steel is as follows $$C>(12/48)\cdot Ti+(12/51)\cdot(3/4)\cdot V.$$

* * * * *

UNITED STATES PATENT AND TRADEMARK OFFICE

CERTIFICATE OF CORRECTION

PATENT NO. : 5,810,948

DATED : September 22, 1998

INVENTOR(S) : Takeshi NISHIWAKI, et al.

It is certified that error appears in the above-indentified patent and that said Letters Patent is hereby corrected as shown below:

Column 4, line 34, after "content" insert --is--.

Column 4, line 51, between "and" and "test" insert --a--

Column 5, Table 1, fifth line under "Ti", change "0.014B" to --0.0148--.

Column 8, line 30, after "it" insert a comma.

Column 13, line 25, change "comparative" to --comparable--.

Column 14, line 5, change "gringing" to --grinding--.

Column 19, Table 7, under heading "LDR", align "2.03" directly under "2.05" and delete"823".

Column 19, Table 2, under heading "Hv", insert -823- directly under "865".

Column 21, Table 8 (2), next to last line under heading "V", change "0.05" to --0.15--.

UNITED STATES PATENT AND TRADEMARK OFFICE

CERTIFICATE OF CORRECTION

PATENT NO. : 5,810,948

DATED : September 22, 1998

INVENTOR(S) : Takeshi NISHIWAKI, et al.

It is certified that error appears in the above-indentified patent and that said Letters Patent is hereby corrected as shown below:

Column 29, line 43, change "least" to --most--.

Column 30, line 29, change "least" to --most--.

Column 30, line 39, after "claim 6" insert a comma and --or 7,--.

Column 30, line 41, delete "nitriding".

Signed and Sealed this

Eighteenth Day of April, 2000

*Attest:*

Q. TODD DICKINSON

*Attesting Officer*

*Director of Patents and Trademarks*